US009056460B2

(12) United States Patent
Iwata et al.

(10) Patent No.: US 9,056,460 B2
(45) Date of Patent: Jun. 16, 2015

(54) IMAGE FORMING APPARATUS AND METHOD FOR CONTROLLING LIQUID DROPLET DISCHARGE HEAD

(71) Applicants: Shuusuke Iwata, Kanagawa (JP); Naoko Kitaoka, Kanagawa (JP)

(72) Inventors: Shuusuke Iwata, Kanagawa (JP); Naoko Kitaoka, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/267,040

(22) Filed: May 1, 2014

(65) Prior Publication Data

US 2014/0327714 A1 Nov. 6, 2014

(30) Foreign Application Priority Data

May 2, 2013 (JP) ..... 2013-096880
Mar. 5, 2014 (JP) ..... 2014-043302

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01); *B41J 2/04593* (2013.01); *B41J 2/04596* (2013.01)

(58) Field of Classification Search
CPC ..... B41J 2/04588; B41J 2/04541; B41J 2/04573; B41J 2/04593; B41J 2/04591
USPC ..... 347/9–11, 68
See application file for complete search history.

(56) References Cited

U.S. PATENT DOCUMENTS 7,794,034 B2 * 9/2010 Shingyohuchi et al. ..... 347/11
2014/0022294 A1 1/2014 Satou et al.

FOREIGN PATENT DOCUMENTS

JP 05-338165 12/1993
JP 3241352 10/2001
JP 2003-175601 6/2003

* cited by examiner

*Primary Examiner* — An Do
(74) *Attorney, Agent, or Firm* — Harness, Dickey & Pierce, P.L.C.

(57) ABSTRACT

An image forming apparatus includes: a liquid droplet discharge head; a pressure generator; and a driving waveform generator configured to generate a driving waveform including a plurality of pulse units for driving the pressure generator for discharging a liquid droplet. The pulse unit includes one or more first pulses, and one or more second pulses arranged after the first pulses for discharging a liquid droplet. The second pulse has a pulse width that is set in advance to generate a resonance with the liquid droplet discharge head. The first pulse has a pulse width different from the pulse width of the second pulse.

9 Claims, 16 Drawing Sheets

(a)

(b)

IMAGE FORMING APPARATUS AND METHOD FOR CONTROLLING LIQUID DROPLET DISCHARGE HEAD

CROSS-REFERENCE TO RELATED APPLICATIONS

The present application claims priority to and incorporates by reference the entire contents of Japanese Patent Application No. 2013-096880 filed in Japan on May 2, 2013 and Japanese Patent Application No. 2014-043302 filed in Japan on Mar. 5, 2014.

BACKGROUND OF THE INVENTION

1. Field of the Invention

The present disclosure relates to a technique for discharging liquid droplets from a liquid droplet discharge head.

2. Description of the Related Art

There is an ink jet recording apparatus as an example of image forming apparatus such as a printer, a facsimile machine, a copying machine, and a multifunction peripheral including the printer, the facsimile machine, and the copying machine in a combined manner.

In recent years, in order to cause an ink jet recording apparatus to print at a higher speed, a large-sized drop having a large amount of ink droplet are required to be ejected in a stable manner with high frequency driving.

In order to obtain preferable gradation property, a large-sized drop and multiple types of ink droplets of which amounts of ink droplet are less than that of the large-sized drop are required to be ejected independently at the same time. In addition, these multiple types of ink droplets are required to be ejected in a stable manner with high frequency driving.

In order to obtain preferable image quality, it is required to eject multiple types of ink droplets in a stable manner with high frequency driving, even when low viscosity ink is used.

Furthermore, because of the reduction in the sizes of nozzle holes and liquid chambers due to higher density integration of the nozzles, the amount of discharged ink droplet per pulse is decreased, and therefore, it is necessary to configure a driving waveform having many pulses in order to obtain a large-sized drop.

However, when the number of pulses of the driving waveform increases in order to obtain the large-sized drop, the large-sized drop is more likely to be affected by variation in an acoustic natural period Tc of a pressure chamber, resulting in increase of variation in the ejection speed and the amount of ink droplet for each channel.

Under such background, for example, Japanese Patent Laid-open No. 2003-175601 discloses a technique for suppressing variation of the acoustic natural period Tc.

In Japanese Patent Laid-open No. 2003-175601, a driving waveform is configured such that, in the acoustic natural period Tc of the ink droplet discharge head, the pulses are arranged in such order that the pulse intervals gradually become closer to the acoustic natural period Tc, and a pulse longer than the acoustic natural period Tc and a pulse shorter than the acoustic natural period Tc are arranged alternately. With the configuration of the driving waveform, the variation of the speeds of the ink droplets adjacent to each other are in the opposite direction, so that the variation of the acoustic natural period Tc is cancelled.

However, in the configuration of the driving waveform described in Japanese Patent Laid-open No. 2003-175601 explained above, when the number of pulses is increased in order to increase the amount of ink droplet, a pulse out of a resonance peak is frequently used in the former half of the waveform, and this may result in reduction of the stability of the discharge. Furthermore, a pulse close to the resonance peak is frequently used in the latter half of the waveform, and therefore, the residual vibration is amplified more than necessary. Thus, the effect of the residual vibration is increased until a subsequent discharge cycle, and this may reduce the stability of discharge.

There is a need for an image forming apparatus that enables preferable discharge stability.

SUMMARY OF THE INVENTION

According to an embodiment, an image forming apparatus includes: a liquid droplet discharge head; a pressure generator; and a driving waveform generator configured to generate a driving waveform including a plurality of pulse units for driving the pressure generator for discharging a liquid droplet. The pulse unit includes one or more first pulses, and one or more second pulses arranged after the first pulses for discharging a liquid droplet. The second pulse has a pulse width that is set in advance to generate a resonance with the liquid droplet discharge head. The first pulse has a pulse width different from the pulse width of the second pulse.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 5:
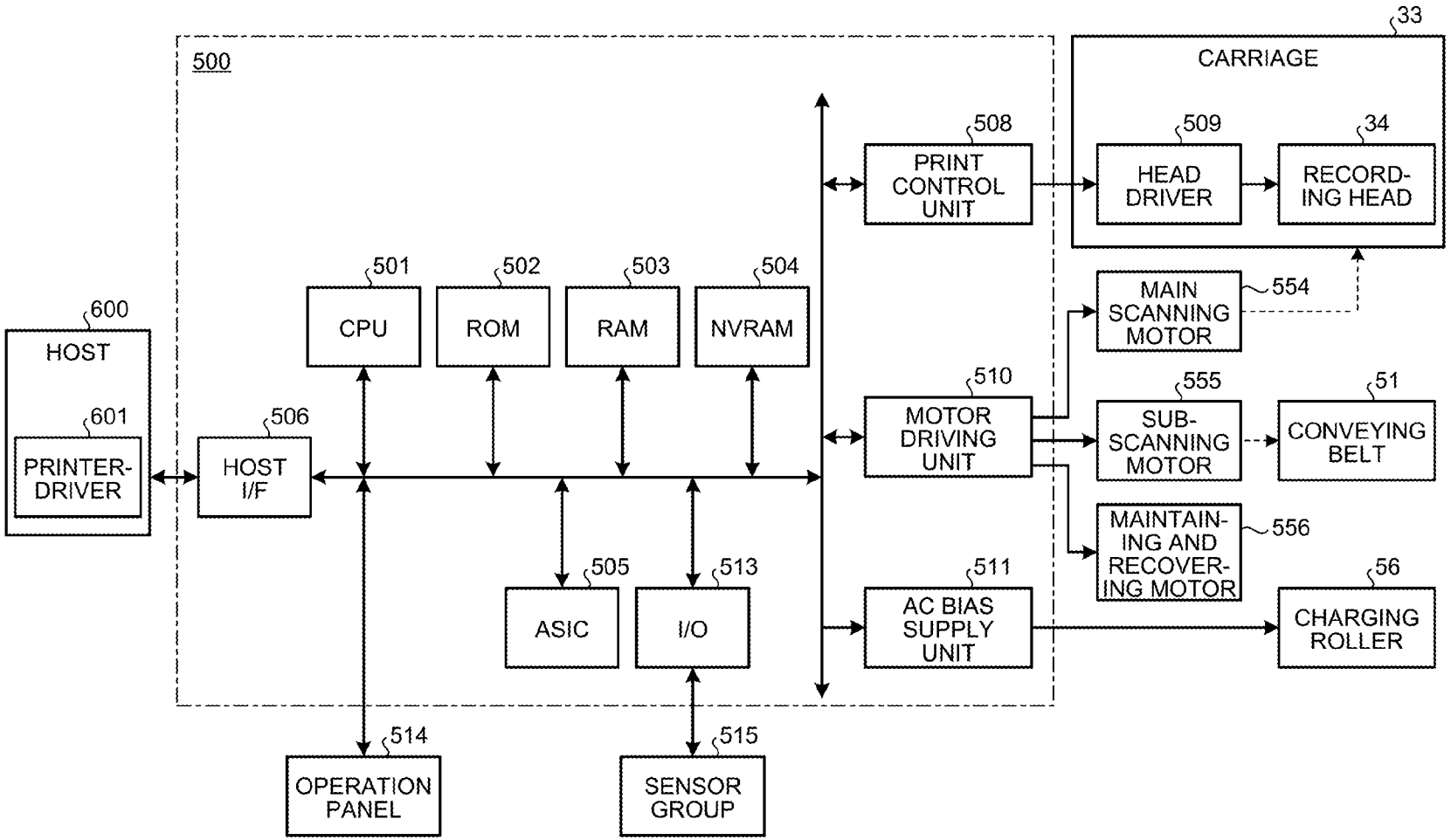
FIG. 5 is a diagram for explaining a control unit of the ink jet recording apparatus.
Figure 6:
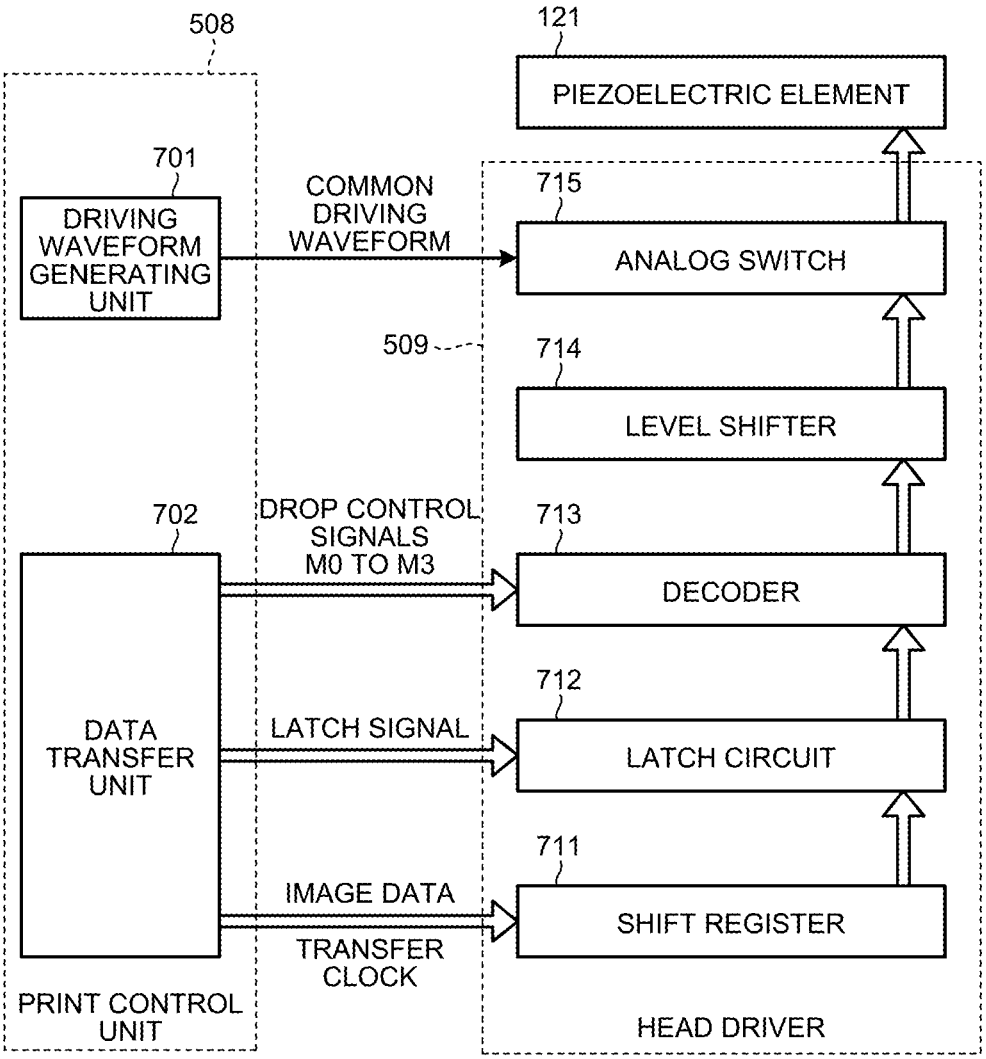
FIG. 6 is a diagram for explaining an example of electrical configuration for head driving control.
Figure 9:
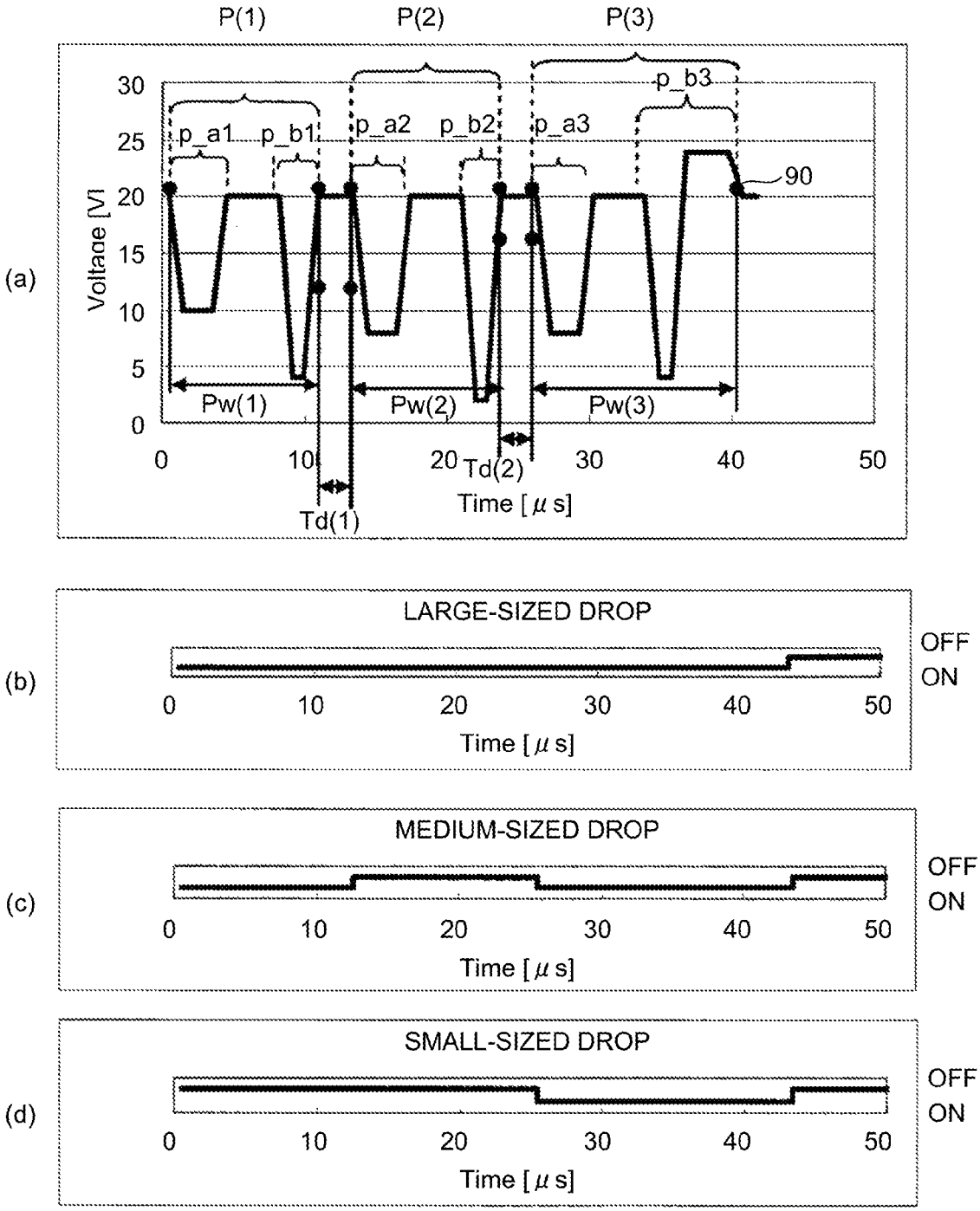
FIG. 9 is a diagram illustrating an example of configuration of a driving waveform of a driving waveform according to the embodiment, and examples of configurations in cases where a large-sized drop, a medium-sized drop, and a small-sized drop are driven.

Overview of control device and liquid droplet discharge device according to an embodiment First, overview of a control device and a liquid droplet discharge device according to an embodiment will be explained with reference to FIGS. 5, 6, and 9. FIGS. 5 and 6 illustrate examples of configurations of the control device and the liquid droplet discharge device according to the embodiment. FIG. 9 illustrates examples of configurations of driving waveforms.

The liquid droplet discharge device according to the embodiment includes a liquid droplet discharge head, a driving waveform generating unit, and a selecting unit.

The liquid droplet discharge head discharges liquid droplets. For example, a recording head 34 as shown in FIG. 5 functions as the liquid discharge head.

The driving waveform generating unit generates a driving waveform including multiple pulse units to drive a pressure generating unit of the liquid droplet discharge head. For example, a piezoelectric element 121 as shown in FIG. 6 functions as a pressure generator. For example, a driving waveform generating unit 701 as shown in FIG. 6 functions as a driving waveform generator. The driving waveform generating unit 701 generates a driving waveform 90 including multiple pulse units P(k) as shown in section (a) of FIG. 9. FIG. 9 shows a case where k is 3. The number of pulse units is not limited to 3 (k=3). The number of pulse units may be any number as long as it is equal to or more than 2 (k≥2). The pulse unit is a unit of a driving waveform including one or more pulses.

The selecting unit selects one or more pulse units P(k) from among the multiple pulse units, and causes the liquid droplet discharge head to eject one or more types of liquid droplets having different volumes, independently of each other. For example, for the large-sized drop as shown in section (b) of FIG. 9, P(1)+P(2)+P(3) is selected. For the medium-sized drop as shown in section (c) of FIG. 9, P(1)+P(3) is selected. For the small-sized drop as shown in section (d) of FIG. 9, P(3) is selected. For example, a head driver 509 as shown in FIG. 6 functions as a selecting unit.

As shown in FIG. 9, the pulse unit P(k) according to the embodiment includes one or more first pulses p_ak(i) and one or more second pulses p_bk(j) arranged after the first pulses p_ak(i). The pulse width of the second pulse p_bk(j) is equal to ½ of the Helmholtz period (acoustic natural period Tc) of the liquid droplet discharge head (½ Tc). The pulse width of the first pulse p_ak(i) is a predetermined width (for example, about ¾ Tc) which is different from ½ of the Helmholtz period of the liquid droplet discharge head. The pulse width of the second pulse p_bk(j) is not limited to ½ Tc. The pulse width of the second pulse p_bk(j) may be set in advance as a pulse width to generate resonance with the liquid droplet discharge head. For example, the pulse width of the second pulse p_bk(j) may be within a predetermined error range from ½ Tc (a pulse width of which error with respect to ½ Tc is less than a predetermined threshold value). The first pulse p_ak(i) does not require any liquid droplet to be actually discharged by this pulse, and may be a pulse that contributes to, at least, discharge of liquid droplets caused by subsequent pulses (e.g., the second pulse).

As described above, in the present embodiment, liquid droplets are discharged using a driving waveform including multiple pulse units each of which is a unit including a pulse close to the resonance peak (the second pulse) and a pulse out of the resonance peak (the first pulse). More specifically, the pulse close to the resonance peak and the pulse out of the resonance peak can be distributed within one driving waveform. Therefore, preferable stability of the discharge can be obtained. More specifically, for example, this can avoid reduction of the discharge stability caused by the pulse out of the resonance peak that is used many times in the first half of the waveform. In addition, this can avoid reduction of the discharge stability caused by the pulse close the resonance peak that is used many times in the first latter of the waveform which increases the residual vibration. The liquid droplet discharge device according to the embodiment will be hereinafter explained in details with reference to attached drawings. In the followings, an ink jet recording apparatus including a liquid droplet discharge device will be used as an example.

Overview of Example of Configuration of Ink Jet Recording Apparatus

Figure 1:
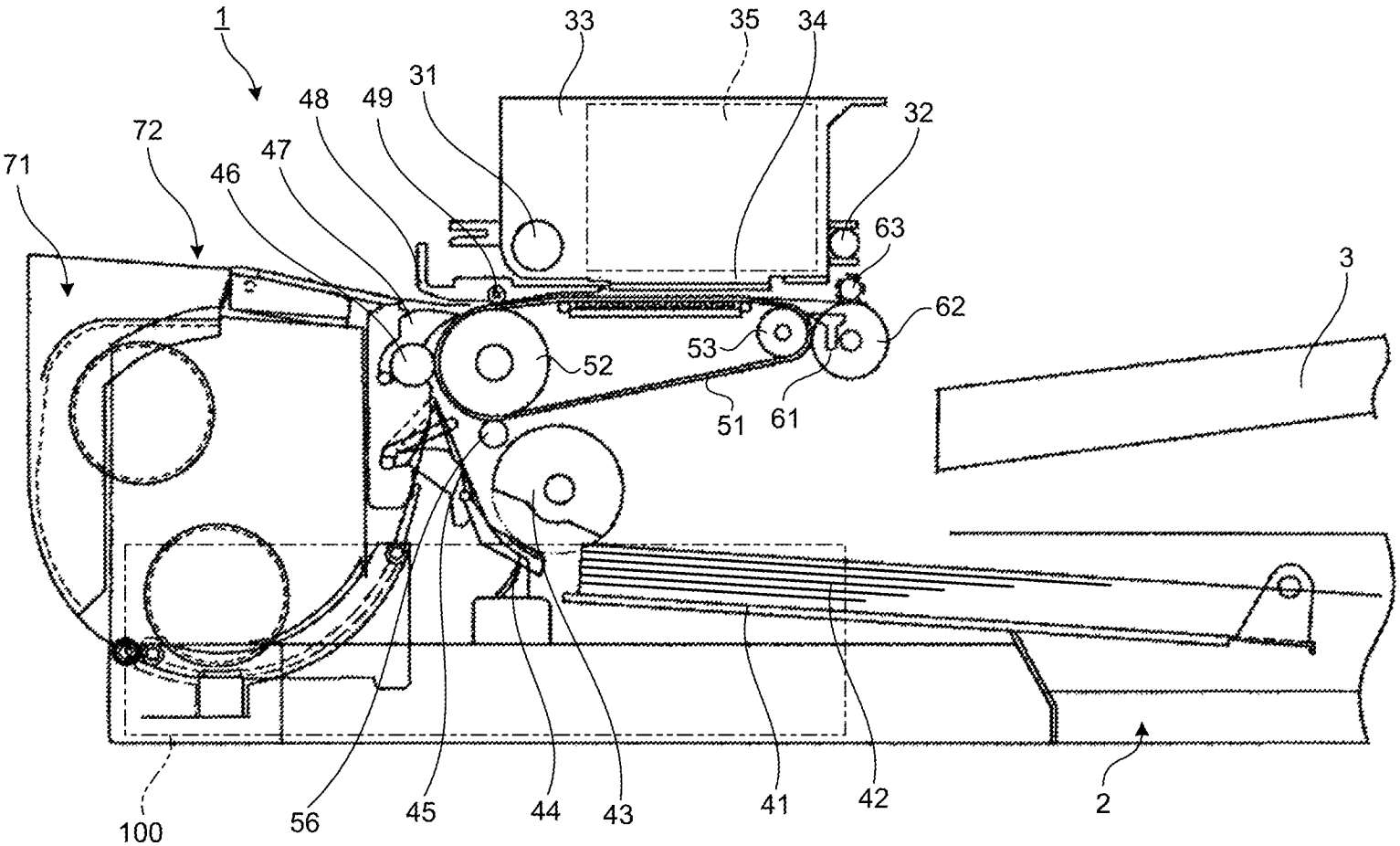
FIG. 1 is a schematic diagram illustrating an example of configuration of an ink jet recording apparatus.
Figure 2:
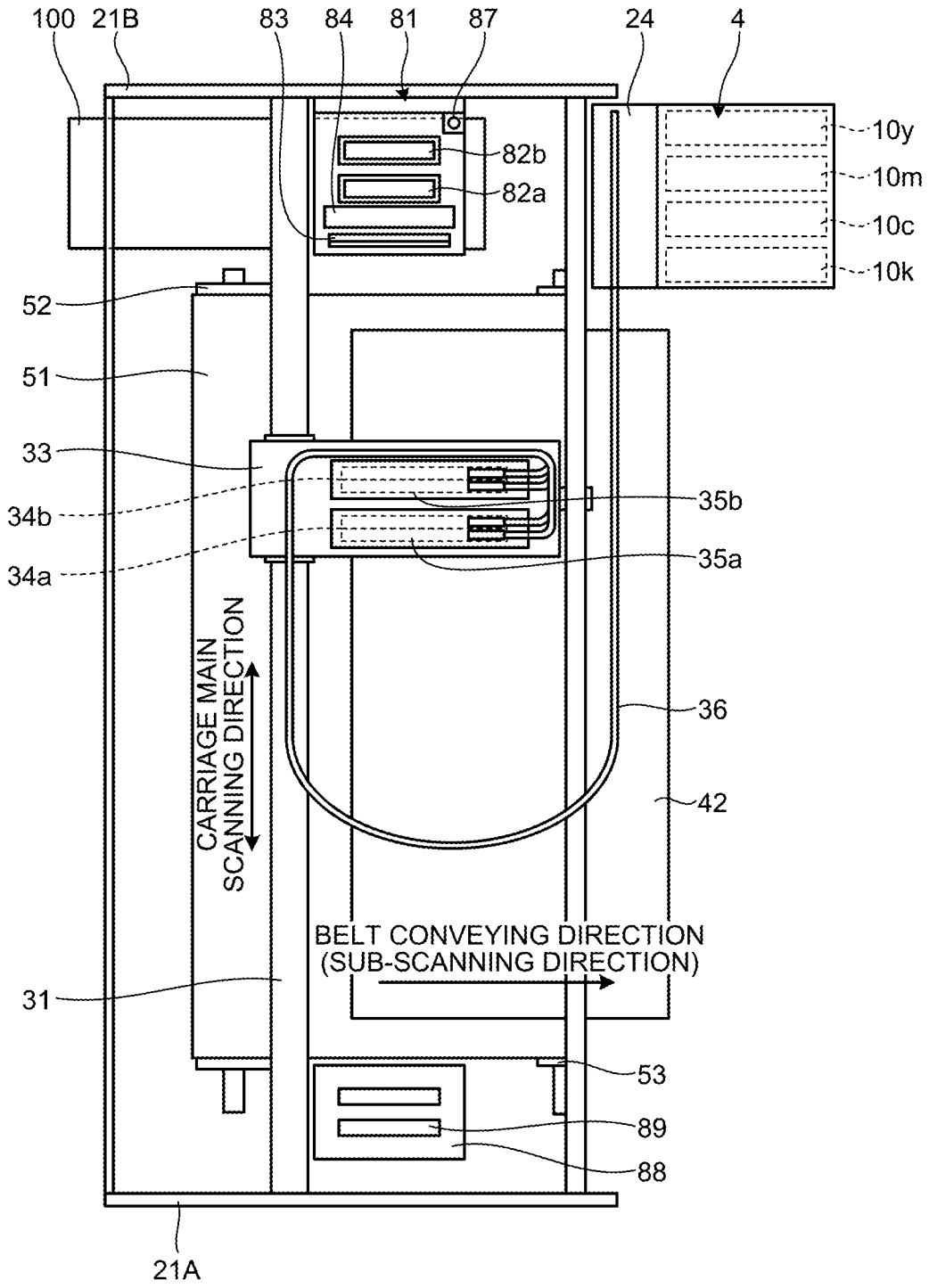
FIG. 2 is a diagram illustrating an example of configuration of a main portion of the ink jet recording apparatus.

First, the ink jet recording apparatus according to the embodiment will be explained with reference to FIGS. 1 and 2. FIG. 1 is a schematic diagram illustrating an example of configuration of the ink jet recording apparatus. FIG. 2 is a diagram illustrating an example of configuration of a main portion of the ink jet recording apparatus.

The ink jet recording apparatus according to the present embodiment is a serial-type ink jet recording apparatus. A carriage 33 is held by main and sub-guide rods 31, 32 which are guide members horizontally provided on right and left side plates 21A, 21B of the device main body 1, in such a manner that the carriage 33 can slide in the main-scanning direction. This carriage 33 makes scanning movement in a direction indicated by the arrow in FIG. 2 (carriage main-scanning direction) by means of a timing belt driven by a main scanning motor not shown.

The carriage 33 includes recording heads 34*a*, 34*b* arranged in the main-scanning direction. The recording heads 34*a*, 34*b* include liquid droplet discharge heads for discharging ink droplets in colors, i.e., yellow (Y), cyan (C), magenta (M), black (K). When the recording heads 34*a*, 34*b* are not distinguished from each other, the recording heads 34*a*, 34*b* will be explained simply as recording heads 34. The recording head 34 has a nozzle row including multiple nozzles in a sub-scanning direction perpendicular to the main-scanning direction, and is attached in such orientation that the ink droplet discharge direction is in the downward direction.

Each of the recording heads 34 includes two nozzle rows. One of the nozzle rows of the recording head 34*a* discharges ink droplets in black (K), and the other of the nozzle rows of the recording head 34*a* discharges ink droplets in cyan (C). One of the nozzle rows of the recording head 34*b* discharges ink droplets in magenta (M), and the other of the nozzle rows of the recording head 34*b* discharges ink droplets in yellow (Y). It should be noted that recording head 34 may be, e.g., a recording head that has nozzle rows of the colors having multiple nozzles arranged in a nozzle surface.

The carriage 33 includes sub-tanks 35*a* and 35*b* which are sub-tanks serving as second ink supply units for providing inks in the colors corresponding to the nozzle rows of the recording heads 34. When the sub-tanks 35*a* and 35*b* are not distinguished from each other, the sub-tanks 35*a* and 35*b* will be explained simply as sub-tanks 35.

The inks of the colors are filled and supplied to the sub-tanks 35 from the ink cartridges (main tanks) 10*y*, 10*m*, 10*c*, and 10*k* of the colors detachably loaded to the cartridge loading unit 4 via the supply tubes 36 of the colors by the supply pump unit 24.

A semicircular roller (sheet feeding roller) 43 and a separation pad 44 are provided as a sheet feeding unit for feeding sheets 42 stacked on a sheet stacking unit (pressurizing plate) 41 of the sheet feeding tray 2. The semicircular roller (sheet feeding roller) 43 separates and feeds the sheets 42, one by one, from the sheet stacking unit 41. The separation pad 44 faces the sheet feeding roller 43, and is made of a material having a high frictional coefficient. The separation pad 44 urged toward the sheet feeding roller 43.

A guide member 45 for guiding a sheet 42, a counter roller 46, a conveying guide member 47, and a pressing member 48 having a leading edge pressurizing roller 49 are provided to convey the sheet 42 fed from the sheet feeding unit into the lower side of the recording head 34. In addition, a conveying belt 51 is provided, which is a conveying unit for electrostatically attracting the fed sheet 42 and conveying the sheet 42 at the position facing the recording head 34.

The conveying belt 51 is an endless belt, and is disposed between a conveying roller 52 and a tension roller 53. The conveying belt 51 is configured to go around in a belt conveying direction (sub-scanning direction). A charging roller 56 which is a charging unit for charging the surface of the conveying belt 51 is provided.

The charging roller 56 is arranged to come into contact with the surface layer of the conveying belt 51 and rotate by being driven by the rotation of the conveying belt 51. The conveying belt 51 rotates and moves in a belt conveying direction (sub-scanning direction) as shown in FIG. 2 when the conveying belt 51 is rotated and driven by the conveying roller 52 by means of timing belt which is driven by a sub-scanning motor, not shown.

A separation claw 61 for separating the sheet 42 from the conveying belt 51, a sheet discharge roller 62, and a spur 63 which is a sheet discharge roller are provided as a sheet discharge unit for discharging the sheet 42 recorded by the recording head 34. In addition, a sheet discharge tray 3 is provided below the sheet discharge roller 62.

A duplex unit 71 is detachably attached to the back surface portion of the device main body 1. The duplex unit 71 retrieves and switches back the sheet 42 returned back by the inverse direction rotation of the conveying belt 51, and feeds the sheet into between the counter roller 46 and the conveying belt 51. A manual feeding tray 72 is provided on the upper surface of the duplex unit 71.

In a non-print area at one side in the scanning direction of the carriage 33, a maintaining and recovery mechanism 81 is provided to maintain and recover the state of the nozzles of the recording heads 34.

In the maintaining and recovery mechanism 81, cap members (hereinafter referred to as "cap") 82*a*, 82*b* are provided to cap each nozzle surface of the recording heads 34. When the caps 82*a*, 82*b* are not distinguished from each other, the caps 82*a*, 82*b* will be referred to as caps 82. In the maintaining and recovery mechanism 81, a wiper member (wiper blade) 83 is provided to wipe the nozzle surfaces. In the maintaining and recovery mechanism 81, a blank-discharge receiver 84 is provided to receive liquid droplets when blank-discharged is performed to discharge liquid droplets that do not contribute to recording in order to discharge recording liquid of which viscosity has increased. In the maintaining and recovery mechanism 81, a carriage lock 87 is provided to lock the carriage 33.

At a lower side of the maintaining and recovery mechanism 81, a waste liquid tank 100 for accommodating waste liquid generated by the maintenance and recovery operation is attached to the device main body 1 in such a manner that the waste liquid tank 100 is replaceable.

In a non-print area at the other side in the scanning direction of the carriage 33, a blank-discharge receiver 88 is provided. In the blank-discharge receiver 88, opening portions 89 and the like are provided along the nozzle row direction of the recording heads 34. The blank-discharge receiver 88 is to receive liquid droplets when blank-discharged is performed to discharge liquid droplets that do not contribute to recording in order to discharge recording liquid of which viscosity has increased.

In the ink jet recording apparatus configured as described above, the sheets 42 are separated, one by one, and fed from the sheet feeding tray 2. The sheets 42 fed to a substantially vertically upper side are guided by the guide member 45. Then, the sheets 42 are conveyed while the sheets 42 are sandwiched between the conveying belt 51 and the counter roller 46. Further, the leading edge of the sheet 42 is guided by the conveying guide member 47, and the sheet 42 is pressed onto the conveying belt 51 by the leading edge pressurizing roller 49, and the sheet 42 is turned substantially 90 degrees in the conveying direction.

At this occasion, a voltage which alternates a plus output and a minus output, i.e., an alternate voltage, is applied to the charging roller 56. Then, an alternate charging voltage pattern is applied to the conveying belt 51. More specifically, the conveying belt 51 is charged in such a manner that plus and minus are alternately formed in a belt-like shape having a predetermined width in the sub-scanning direction which is the circulating direction. When the sheet 42 is fed to the conveying belt 51 charged alternately to plus and minus, the sheet 42 is attracted to the conveying belt 51, the sheets 42 are conveyed in the sub-scanning direction according to the circulating movement of the conveying belt 51. Then, the recording heads 34 are driven in accordance with an image signal while the carriage 33 is moved, so that liquid droplets for one line are discharged and recorded on the sheet 42. After the sheet 42 is conveyed for a predetermined amount, a subsequent line is recorded. When a recording end signal is received or a signal indicating that the tail edge of the sheet 42 reaches a recording area is received, the ink jet recording apparatus terminates the recording operation, and the sheet 42 is discharged to the sheet discharge tray 3.

When the nozzles of the recording heads 34 are maintained and recovered, the carriage 33 is moved to the position facing the maintaining and recovery mechanism 81 which is the home position. Then, capping is done with the caps 82, and the maintaining and recovering operation such as nozzle suction for sucking through the nozzles and blank-discharge operation for discharging liquid droplets that do not contribute to image formation is performed, which enables image formation with stable liquid droplet discharge.

Example of Configuration of Liquid Droplet Discharge Head

Figure 3:
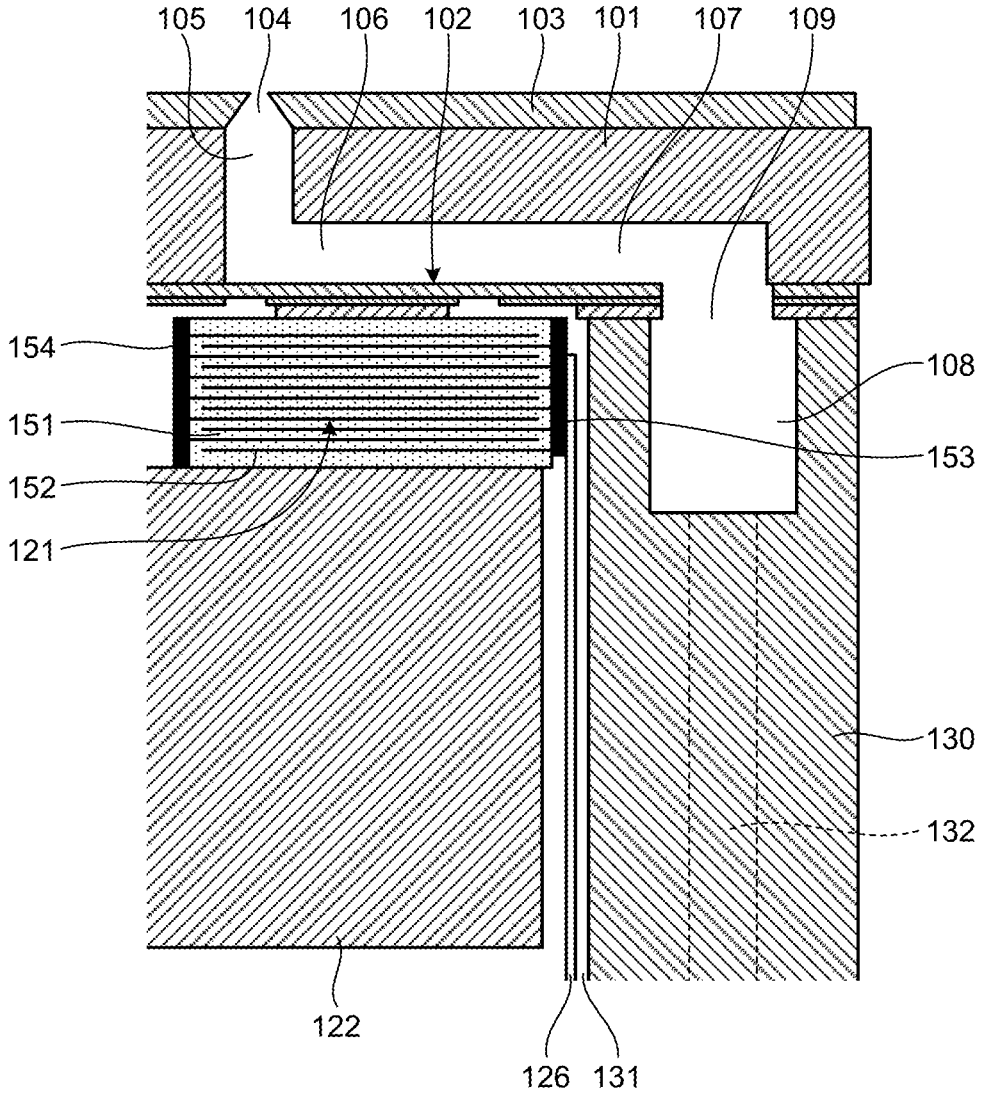
FIG. 3 is a cross sectional view taken along the longitudinal direction of a liquid chamber for explaining a liquid chamber structure of a liquid droplet discharge head.
Figure 4:
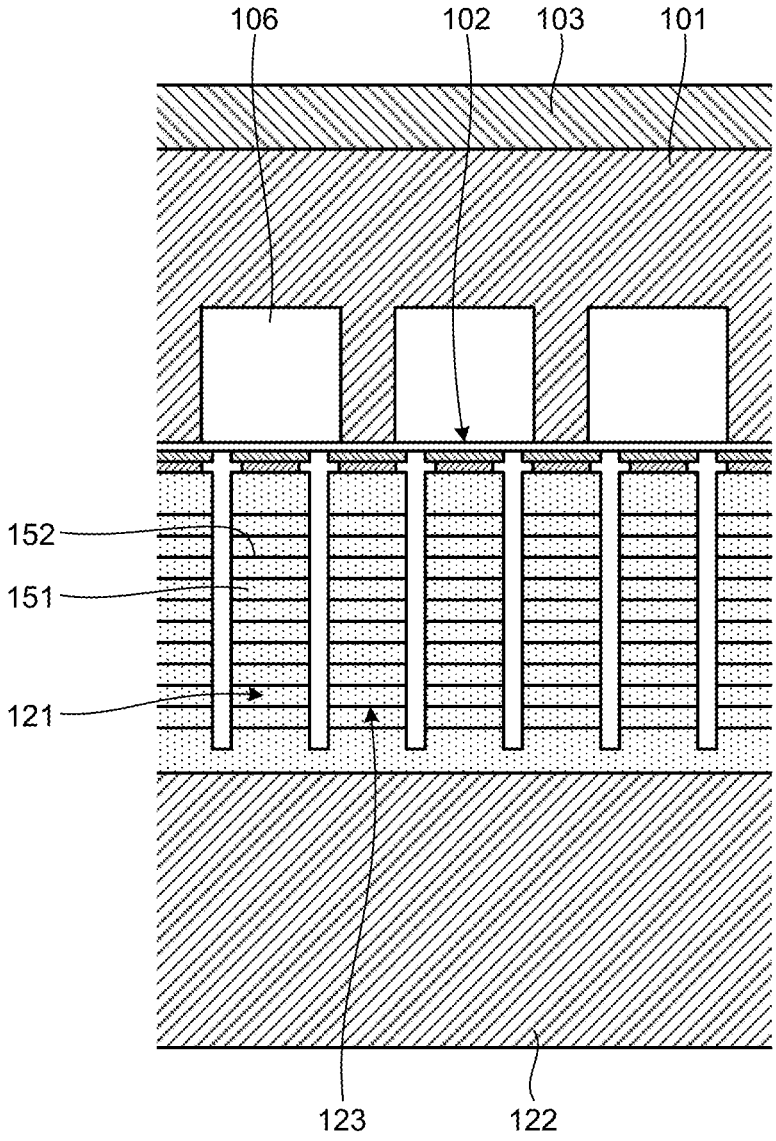
FIG. 4 is a cross sectional view taken along the lateral direction of the liquid chamber for explaining the liquid chamber structure of the liquid droplet discharge head.

Subsequently, an example of configuration of the liquid droplet discharge head (the recording head 34) according to the present embodiment will be explained with reference to FIGS. 3 and 4. FIG. 3 is cross sectional view taken along the longitudinal direction of the liquid chamber of the liquid droplet discharge head. FIG. 4 is cross sectional view taken along the lateral direction of the liquid chamber of the liquid droplet discharge head.

The liquid droplet discharge head according to the present embodiment has a stacking structure including: a channel plate 101 formed by anisotropically etching a monocrystalline silicon substrate; a vibration plate 102, which is formed of electroformed nickel, joined with the lower surface of the channel plate 101; and a nozzle plate 103 joined with the upper surface of the channel plate 101. A nozzle communication channel 105, a liquid chamber 106, an ink supply port 109, and the like are formed with these plates. The nozzle communication channel 105 is a flow path in communication with the nozzle 104 discharging liquid droplets (ink droplets). The liquid chamber 106 is a portion for generating the pressure. The ink supply port 109 is a portion in communication with a common liquid chamber 108 for supplying ink via a fluid resistance portion (supply channel) 107 to the liquid chamber 106.

In addition, two-rows of stacked-type piezoelectric elements 121 are provided, which is a pressure generating unit (actuator unit) for pressurizing the ink in the liquid chamber 106 by deforming the vibration plate 102. In FIG. 3, only one row of piezoelectric element 121 is shown. In the explanation below, the stacked-type piezoelectric element 121 will be referred to as a piezoelectric element 121. The liquid droplet discharge head includes a base substrate 122 for joining and fixing the piezoelectric element 121. A support pillar part 123 is provided between the piezoelectric elements 121. This support pillar part 123 is a portion formed together with the piezoelectric element 121 by dividing and processing the piezoelectric element member, and simply serves as a support pillar because no driving voltage is applied thereto. The piezoelectric element 121 is connected to an FPC cable 126 provided with a driving circuit (driving IC), not shown.

The peripheral portion of the vibration plate 102 is joined with the frame member 130. This frame member 130 is formed with a penetrating part 131, a concave portion which is to be a common liquid chamber 108, and an ink supply hole 132. The penetrating part 131 is a portion for accommodating an actuator unit constituted by a piezoelectric element 121, a base substrate 122, and the like. The ink supply hole 132 is a portion for providing ink to the common liquid chamber 108 from the outside. The frame member 130 is formed with, for example, a thermosetting resin such as epoxy resin or injection molding with polyphenylene sulfide.

The channel plate 101 is made by, for example, anisotropically etching a monocrystalline silicon substrate of a crystal plane direction using alkaline etching liquid such as potassium hydroxide solution (KOH) and making a concave portion and a hole portion which are the nozzle communication channel 105 and the liquid chamber 106. It should be noted that the channel plate 101 is not limited to the monocrystalline silicon substrate, and may be made of other stainless substrates, photosensitive resins, and the like.

The vibration plate 102 is formed with a nickel metal plate. The vibration plate 102 is made by, for example, electroforming method (electroforming method). Other than that, the material of the vibration plate 102 may be of a metal plate and a joined member including metal and resin plate. The piezoelectric element 121 and the support pillar part 123 are joined with the vibration plate 102 with adhesive agent, and further, the frame member 130 is joined with adhesive agent.

The nozzle plate 103 has nozzles 104 of which diameters are 10 to 30 μm in association with the liquid chambers 106, and is joined with the channel plate 101 with adhesive agent. This nozzle plate 103 has a water-repellent layer on the uppermost surface with a predetermined layer interposed on the surface of the nozzle forming member made of the metal member.

The piezoelectric element 121 is a stacked-type piezoelectric element (PZT in this case) made by alternately stacking the piezoelectric material 151 and the internal electrode 152. An individual electrode 153 and a common electrode 154 are connected to the internal electrodes 152 drawn to alternately different end surfaces of the piezoelectric element 121. The present embodiment is configured such that the ink in the liquid chamber 106 is pressurized using displacement in the piezoelectric direction of the piezoelectric element 121. A single base substrate 122 may be provided with a single row of piezoelectric elements 121.

In the liquid droplet discharge head configured as described above, for example, the voltage applied to the piezoelectric element 121 is decreased from the reference potential, so that the piezoelectric element 121 is shrunk, and the vibration plate 102 descends to expand the volume of the liquid chamber 106, so that the ink flows into the liquid chamber 106. Thereafter, the voltage applied to the piezoelectric element 121 is increased to elongate the piezoelectric element 121 in the stacking direction. Then, the vibration plate 102 is deformed in the direction of the nozzle 104, and the capacity/volume of the liquid chamber 106 is shrunk, so that the ink in the liquid chamber 106 is pressurized, and an ink drop is discharged (ejected) from the nozzle 104.

Then, the voltage applied to the piezoelectric element 121 is returned back to the reference potential, whereby the vibration plate 102 recovers back to the initial position, and the liquid chamber 106 is expanded to generate a negative pressure. At this occasion, the ink is filled from the common liquid chamber 108 into the liquid chamber 106. Subsequently, after the vibration of the meniscus surface of the nozzle 104 is attenuated and stabilized, operation for a subsequent liquid droplet discharge is performed.

The method for driving the liquid droplet discharge head is not limited to the above example (pulling/pushing discharge). Alternatively, depending on how the driving waveform is given, pulling discharge, pushing discharge, and the like may also be performed.

Example of Configuration of Control Unit 500 of Ink Jet Recording Apparatus

Subsequently, an example of configuration of the control unit 500 of the ink jet recording apparatus according to the present embodiment will be explained with reference to FIG. 5. For example, the control unit 500 corresponds to a control device. The control device may have a configuration other than the control unit 500. FIG. 5 is a diagram illustrating an example of configuration of the control unit 500 of the ink jet recording apparatus according to the present embodiment.

The control unit 500 of the ink jet recording apparatus according to the present embodiment is a unit for controlling the entire apparatus, and includes a CPU 501, a ROM 502, a RAM 503, a nonvolatile memory 504, an ASIC 505, a host I/F 506, a print control unit 508, a motor driving unit 510, an AC bias supply unit 511, and an I/O 513. The CPU 501 also serves as a unit for controlling the blank-discharge operation. The ROM 502 stores therein programs executed by the CPU 501 and other fixed data. The RAM 503 temporarily stores therein image data and the like. The nonvolatile memory 504 is a rewritable memory for holding data even when the power supply of the ink jet recording apparatus is shut off. The ASIC 505 performs various kinds of signal processing on image data, image processing for performing sorting and the like, and processes an input/output signal for controlling the entire apparatus.

The print control unit 508 includes a data transfer unit (the data transfer unit 702 of FIG. 6) and a driving waveform generating unit (the driving waveform generating unit 701 of FIG. 6) for driving and controlling the recording heads 34 provided on the carriage 33. The driving waveform generating unit includes a D/A conversion device for D/A converting pattern data of a driving pulse stored in the ROM 502, a voltage amplification device, an electric current amplification device, and the like. The carriage 33 includes a head driver (driver IC) 509 for driving the recording heads 34 provided on the carriage 33. The motor driving unit 510 drives a main scanning motor 554, a sub-scanning motor 555, and a maintaining and recovering motor 556. The main scanning motor 554 causes the carriage 33 to make scanning movement. The sub-scanning motor 555 rotates and moves the conveying belt 51. The maintaining and recovering motor 556 is a motor for the maintaining and recovery mechanism 81. The AC bias supply unit 511 provides AC bias to the charging roller 56.

The control unit 500 is connected to an operation panel 514 for input and display of information required for this apparatus.

The host I/F 506 is an interface for transmitting and receiving data and signals to/from a host. Therefore, with the host I/F 506, data and signals are received via a cable or a network from the host 600 such as an information processing apparatus such as a personal computer, an image reading apparatus such as an image scanner, and an image-capturing apparatus such as a digital camera.

The CPU 501 reads and analyzes print data in a reception buffer included in a host I/F 506. The ASIC 505 performs necessary image processing, sort processing of data, and the like, and transfers the image data from the print control unit 508 to the head driver 509. It should be noted that the generation of dot pattern data for image output may be done by the printer driver 601 at the host 600 or the control unit 500.

The print control unit 508 transfers the above described image data as serial data, a transfer clock and a latch signal required for transfer of the image data and determining the transfer, a control signal, and the like to the head driver 509. The driving waveform generating unit of the print control unit 508 outputs a driving waveform including one driving pulse or multiple driving pulses as common driving waveforms to the head driver 509.

The head driver 509 functions as a selecting unit for selecting a driving pulse included in a driving waveform given by the print control unit 508 on the basis of image data corresponding to one recording line of the recording heads 34 which are input in a serial manner. Then, the driving pulse selected by the selecting unit is applied to the piezoelectric element 121 serving as the pressure generator, so that the liquid droplet discharge head of the recording head 34 is driven. In the present embodiment, by causing the selecting unit to select a driving pulse included in a driving waveform, for example, one or more types of liquid droplets having different volumes, such as a large-sized drop, a medium-sized drop, and a small-sized drop, can be ejected independently of each other.

The I/O 513 obtains information from various kinds of sensor group 515 provided on the apparatus, and extracts information required for control of the printer. The information is used for control of the print control unit 508, the motor driving unit 510, and the AC bias supply unit 511. The sensor group 515 includes an optical sensor for detecting the position of a sheet, a thermistor for monitoring the temperature in the apparatus, a sensor for monitoring the voltage of the charging belt, and an interlock switch for detecting open/close of a cover. The I/O 513 can process various kinds of sensor information.

Example of Electrical Configuration for Head Driving Control

Subsequently, examples of the print control unit 508 and the head driver 509 will be explained with reference to FIG. 6. FIG. 6 is a diagram illustrating an example of electrical configuration for head driving control.

The print control unit 508 includes a driving waveform generating unit 701 and a data transfer unit 702. The driving waveform generating unit 701 generates and outputs a driving waveform (common driving waveform) including multiple driving pulses (driving signal) within a print period when an image is formed. The data transfer unit 702 outputs two-bit image data (gradation level signal 0, 1) corresponding to a print image, a clock signal (transfer clock), a latch signal (LAT), and drop control signals M0 to M3.

It should be noted that the drop control signals M0 to M3 are two-bit signals commanding open/close of an analog switch 715, which is a switch unit of the head driver 509, for each liquid droplet. The drop control signals M0 to M3 transit to the state of the H level (ON) with a waveform which is to be selected according to the print period of the common driving waveform, and transit to the state of L level (OFF) when not selected.

The head driver 509 includes a shift register 711, a latch circuit 712, a decoder 713, a level shifter 714, and an analog switch 715.

The shift register 711 receives a transfer clock (shift clock) and serial image data (gradation level data: two-bit/one channel (one nozzle)) from the data transfer unit 702. The latch circuit 712 latches each register value of the shift register 711 with a latch signal. The decoder 713 decodes the gradation level data and the drop control signals M0 to M3 and outputs a result thereof. The level shifter 714 converts the logic level voltage signal of the decoder 713 into a level with which the analog switch 715 can operate. The analog switch 715 is turned on/off (closed/opened) in response to the output of the decoder 713 given via the level shifter 714.

The analog switch 715 is connected to the selection electrode (individual electrode 153) of each piezoelectric element 121, and receives the common driving waveform from the driving waveform generating unit 701.

In the present embodiment, the analog switch 715 is turned on in accordance with the drop control signals M0 to M3 and the image data (gradation level data) serially transferred, so that a predetermined pulse included in the common driving waveform is passed (selected) and is applied to the piezoelectric element 121.

Although not shown in FIG. 6, the data transfer unit 702 outputs the drop control signal M4, and the head driver (not shown) having the same configuration as the head driver 509 drives the sub-piezoelectric element by providing the common driving waveform with timing when the drop control signal M4 attains the H level (ON).

Example of Driving Pulse (Common Driving Waveform)

Figure 7:
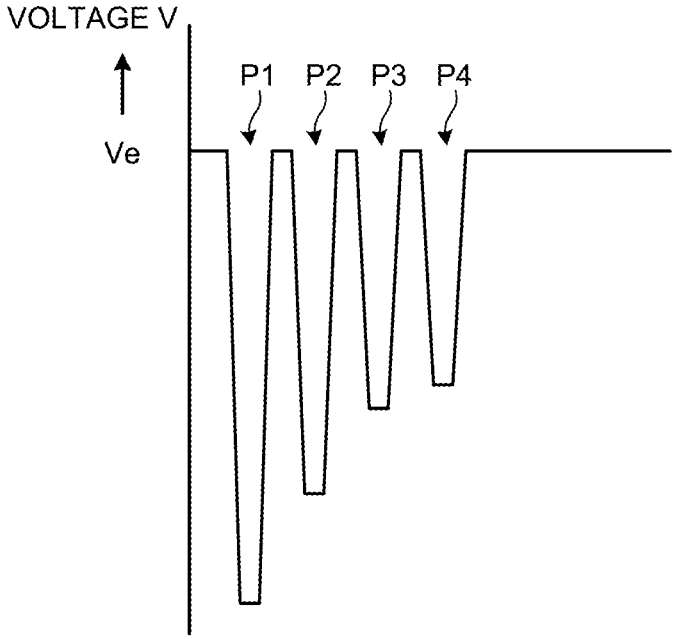
FIG. 7 is a diagram illustrating a typical driving waveform (driving pulse) for head driving.

Subsequently, the driving pulse (common driving waveform) will be explained with reference to FIG. 7. FIG. 7 is a diagram illustrating a typical driving waveform (driving pulse) for driving the liquid droplet discharge head.

The driving waveform generating unit 701 generates and outputs, for example, a driving signal (driving waveform) including continuous multiple driving pulses P1 to P4 as shown in FIG. 7 within one blank-discharge period (one driving period). The driving pulses P1 to P4 include a dropping waveform element that drops from the reference potential Ve, a waveform element that keeps a hold state (a portion where the potential does not change) after dropping, a rising waveform element that rises from the hold state, and the like.

The dropping waveform element is an expanding waveform element by which the piezoelectric element 121 shrinks and the volume of the liquid chamber 106 expands. The rising waveform element is a shrinking waveform element by which the piezoelectric element 121 elongates and the volume of the liquid chamber 106 shrinks.

By the way, in recent years, in order to enable high-speed printing with the ink jet recording apparatus explained above, a large-sized drop of which liquid droplet amount is large is required to be ejected with high frequency driving in a stable manner.

In order to obtain preferable gradation level property, not only the large-sized drop but also multiple types of liquid droplets of which amount is less than that of the large-sized drop are required to be ejected independently of each other at the same time. In addition, these multiple types of liquid droplets are required to be ejected with high frequency driving in a stable manner.

In order to obtain preferable image quality, multiple types of liquid droplets are required to be ejected with high frequency driving in a stable manner even when lower-viscosity ink is used.

Because of the reduction in the sizes of nozzle holes and a liquid chamber due to higher density integration of the nozzle, the amount of discharged liquid droplet per pulse is decreased, and therefore, it is necessary to configure a driving waveform having many pulses in order to obtain a large-sized drop.

Figure 8:
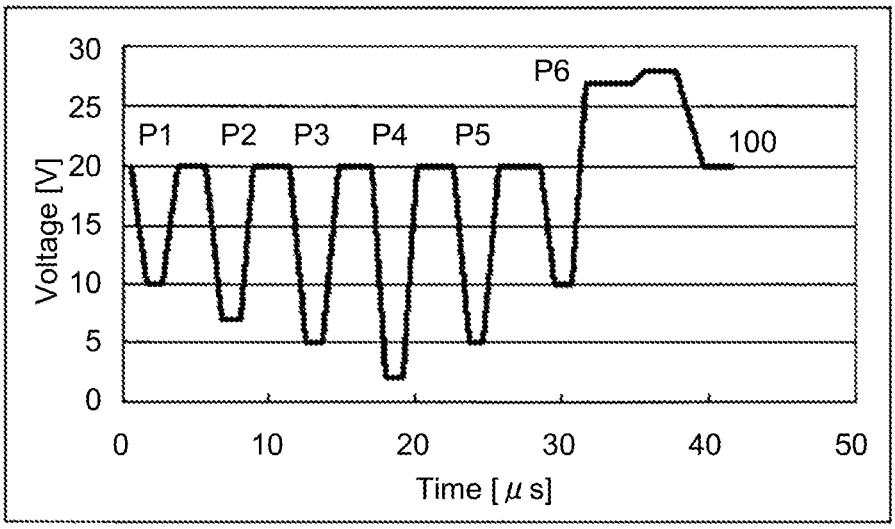
FIG. 8 is a diagram illustrating an example of configuration of a conventional driving waveform.

The example of configuration of the driving waveform explained above will be shown in FIG. 8. FIG. 8 is a diagram illustrating an example of configuration of a conventional driving waveform. In FIG. 8, the vertical axis denotes a voltage, and the horizontal axis denotes a time.

Figure 12:
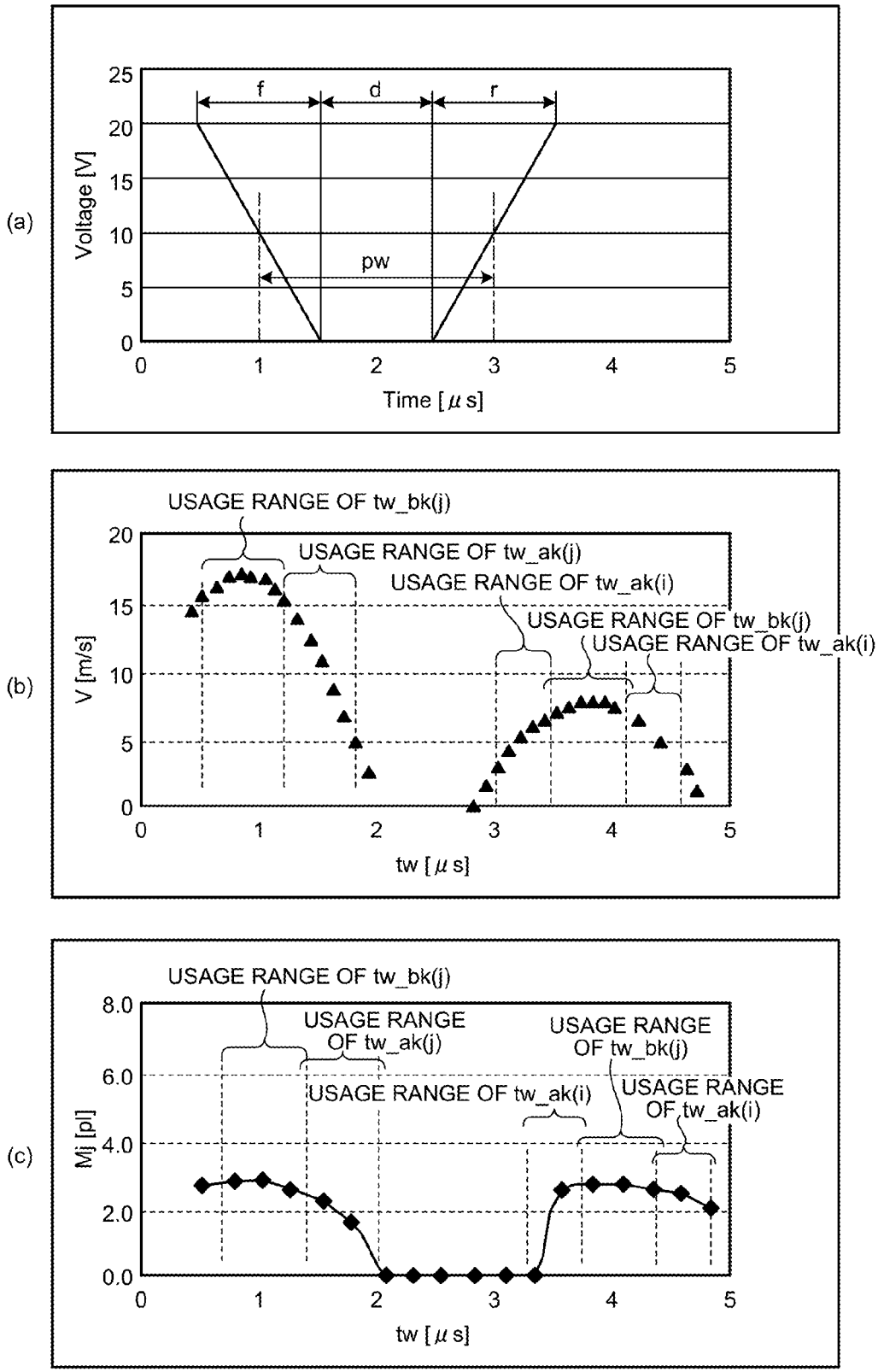
FIG. 12 is a diagram illustrating a relationship of a discharge pulse width, a discharge liquid droplet speed, and a discharge liquid droplet volume with the liquid droplet discharge head.

In the configuration of the driving waveform as shown in FIG. 8, in order to obtain the maximum discharge efficiency of liquid droplet, each pulse width preferably uses the discharge pulse width as shown in FIG. 12 and a portion close to the first peak of the liquid droplet speed characteristic curve. FIG. 12 is a diagram illustrating relationship of discharge pulse width, discharge liquid droplet speed, and discharge liquid droplet volume of the liquid droplet discharge head. Specifically, section (a) of FIG. 12 illustrates the discharge pulse width; section (b) of FIG. 12 illustrates the discharge liquid droplet speed; and section (c) of FIG. 12 illustrates the discharge liquid droplet volume. In section (a) of FIG. 12, the element f indicates a dropping waveform element which is an expanding waveform element. The element d denotes a waveform element in the hold state after dropping. The element r denotes a rising waveform element which is the shrinking waveform element. The pulse width pw means a distance between the middle points of the expanding waveform element and the shrinking waveform element in the same pulse in which the discharge is performed. In section (a) of FIG. 12, the vertical axis denotes a voltage, and the horizontal axis denotes a time. In section of FIG. 12, the vertical axis denotes the speed of the liquid droplet, and the horizontal axis denotes a pulse width (time). In section (c) of FIG. 12, the vertical axis denotes the volume of the liquid droplet, and the horizontal axis denotes a pulse width (time).

As the number of pulses of the driving waveform increases, the large-sized drop is less likely to be influenced by variation in the acoustic natural period Tc of the pressure chamber. Therefore, as shown in FIG. 8, when as many pulses as the number of pulses for ensuring a desired amount of liquid droplet is simply applied, this may results in increase of variation in the ejection speed and the amount of liquid droplet for each channel.

Due to such background, there exists a technique for configuring a driving waveform such that, for the acoustic natural period Tc of the liquid droplet discharge head, the pulses are arranged in such order that the pulse intervals gradually become closer to the acoustic natural period Tc, and a pulse longer than the acoustic natural period Tc and a pulse shorter than the acoustic natural period Tc are arranged alternately. With the configuration of the driving waveform, the variation of the speeds of the liquid droplets adjacent to each other are in the opposite direction, so that the variation of the acoustic natural period Tc can be cancelled.

However, in the example of the configuration of the driving waveform as shown in FIG. 8 explained above, when the number of pulses is increased in order to increase the amount of liquid droplet, a pulse out of a resonance peak is frequently used in the former half of the waveform, and this may result in reduction of the stability of the discharge. A pulse close to the resonance peak is frequently used in the latter half of the waveform, and therefore, the residual vibration is amplified more than necessary. Thus, the effect of the residual vibration is increased until a subsequent discharge cycle, and this may reduce the stability of discharge.

In the present embodiment, in order to solve the above problem, as shown in FIG. 9, a driving waveform 90 including one or more pulse units P(k) is generated, and one or more pulse units P(k) is selectively driven, and one or more types of liquid droplets having different volumes can be ejected independently of each other. FIG. 9 discloses the example of the configuration where a large-sized drop, a medium-sized drop, and a small-sized drop can be ejected independently of each other.

In the present embodiment, the pulse unit P(k) includes one or more first pulses p_ak(i) and one or more second pulses p_bk(j) discharging liquid droplets arranged after the first pulse p_ak(i). The pulse width of the second pulse p_bk(j) is equal to ½ of the Helmholtz period of the liquid droplet discharge head. The pulse width of the first pulse p_ak(i) is a predetermined width different from ½ of the Helmholtz period of the liquid droplet discharge head. Therefore, preferable discharge stability can be obtained.

FIG. 9 is a diagram illustrating the example of the configuration of the driving waveform of a driving waveform 90 according to the present embodiment, and examples of configurations in cases where a large-sized drop, a medium-sized drop, and a small-sized drop are driven.

Specifically, section (a) of FIG. 9 illustrates the example of the configuration of the driving waveform 90 according to the present embodiment; section (b) of FIG. 9 illustrates a case where the large-sized drop is driven; section (c) of FIG. 9 illustrates a case where the medium-sized drop is driven; and section (d) of FIG. 9 illustrates a case where the small-sized drop is driven. In section (a) of FIG. 9, the vertical axis denotes a voltage, and the horizontal axis denotes a time.

The driving waveform 90 as shown in FIG. 9 includes at least k pulse units P(k). However, k=1 to X, X>0. FIG. 9 shows a case where k=3.

The pulse unit P(k) includes M first pulses p_ak(i) and N second pulses p_bk(j), wherein, i=1 to M, M>0, and j=1 to N, N>0. The pulse unit P(k) includes pulses arranged in the following order: p_ak(1), p_ak(2), . . . , p_ak(M), p_bk(1), p_bk(2), . . . , p_bk(N). M and N may be the same number or may be different numbers. The value of M may be different for every k pulse units P(k), or may be the same. Likewise, the value of N may be different for every k pulse units P(k), or may be the same.

In the pulse unit P(1) of section of FIG. 9, M=1 and N=1, and therefore, the pulse unit P(1) is a series of voltage change portion in which the first pulse p_ak(i) includes the first pulse p_a1, the second pulse p_bk(j) includes the second pulse p_b1, and the first pulse p_ak(i), the second pulse p_bk(j) include at least one or more expanding waveform elements and shrinking waveform elements, and then back to the middle potential again.

The Td(1) of section (a) of FIG. 9 denotes a pulse unit interval between the pulse unit P(1) and the pulse unit P(2), and denotes an interval from the end point of the pulse unit P(1) to the start point of the pulse unit P(2). The pulse unit interval is an interval from the end point of the previous pulse unit P(k) to the start point of the subsequent pulse unit P(k+1). The Pw(1) denotes the pulse unit width of the pulse unit P(1). The pulse unit width is a width from the voltage change start point of the first one of the first pulses p_ak(i) included in the pulse unit P(k) (=the start point of the pulse unit P(k)) to the voltage change end point of the last one of the second pulses p_bk(j) included in the pulse unit P(k) (=the end point of the pulse unit P(k)).

When liquid droplets of different sizes are discharged and formed by the liquid droplet discharge head according to the present embodiment, each liquid droplet is selectively driven in units of the pulse unit P(k) as shown in FIG. 9. The large-sized drop as shown in section (b) of FIG. 9 is driven with P(1)+P(2)+P(3). The medium-sized drop as shown in section (c) of FIG. 9 is driven with P(1)+P(3). The small-sized drop as shown in section (d) of FIG. 9 is driven with P(3).

Figure 10:
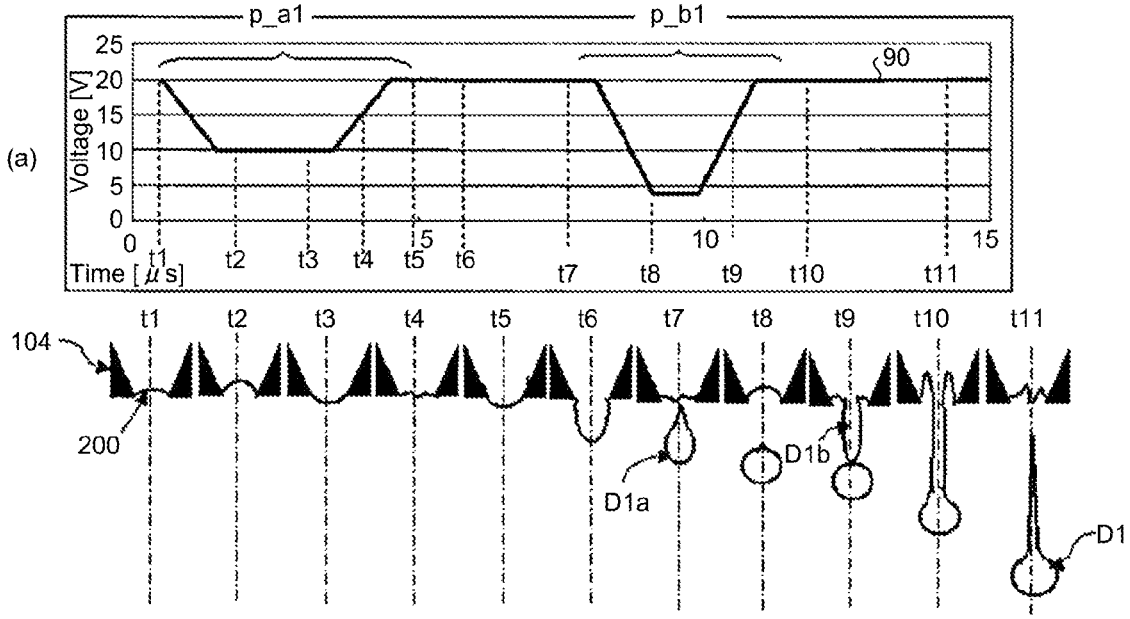
FIG. 10 is a diagram illustrating examples of liquid droplets discharged by selectively driving in unit of pulse unit P(k)
Figure 10:
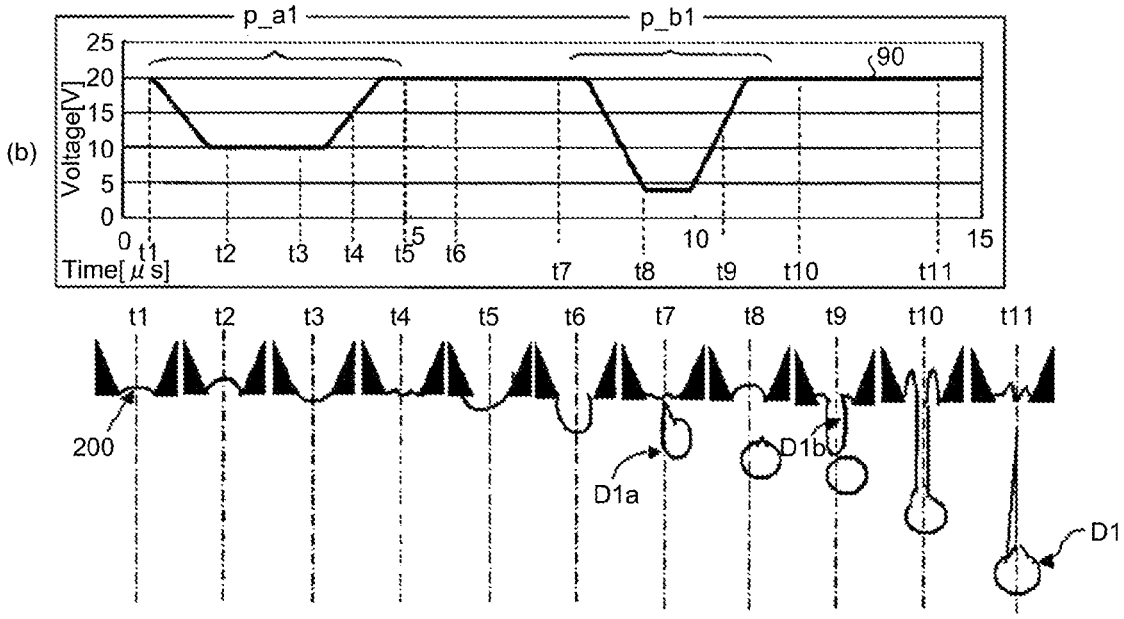

Immediately after the liquid droplets are selectively driven in units of the pulse unit P(k), the liquid droplets discharged with the first pulse p_ak(i) and the second pulse p_bk(j) in the pulse unit P(k) are merged as shown in FIG. 10. In this case, the pulse interval td_ak(i) or td_bk(j) of the first pulse p_ak(i) and the second pulse p_bk(j) is adjusted. The pulse interval td_ak(i) or td_bk(j) is a distance between middle points of the shrinking waveform element of the first pulse p_ak(i) before the discharge and the expanding waveform element of the second pulse p_bk(j) after the discharge.

FIG. 10 is a diagram illustrating liquid droplets discharged by selectively driving in units of pulse unit P(k). Specifically, section (a) of FIG. 10 illustrates a usual discharge; and section (b) of FIG. 10 illustrates a discharge when the meniscus is unstable. In sections (a) and (b) of FIGS. 10A and 10B, the vertical axis denotes a voltage, and the horizontal axis denotes a time. FIG. 10 shows examples of a liquid surface 200 of the liquid droplets from the nozzle 104 before the discharge and the discharged liquid droplets (liquid droplets D1*a*, D1*b*, and D1) at each time. The driving waveform 90 denotes the driving waveform of liquid droplets. A liquid droplet D1*a* indicates a liquid droplet formed with the first pulse p_a1. An liquid droplet D1*b* indicates a liquid droplet formed with the second pulse p_b1. A liquid droplet D1 indicates a merged liquid droplet formed by merging the liquid droplet D1*a* and the liquid droplet D1*b*.

In FIG. 10, the liquid droplets D1*a* and D1*b* discharged with the first pulse p_a1 and the second pulse p_b1 in the pulse unit P(1) are merged to form the merged liquid droplet D1.

Figure 11:
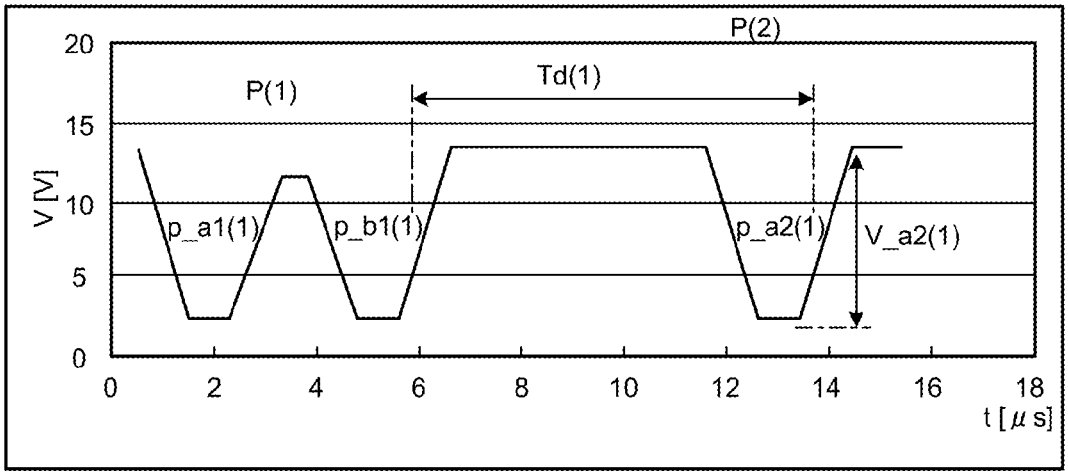
FIG. 11 is a diagram illustrating residual vibrations after a pulse unit P(1) is applied with the liquid droplet discharge head (discharge liquid droplet speed of a subsequent pulse unit P(2))
Figure 11:
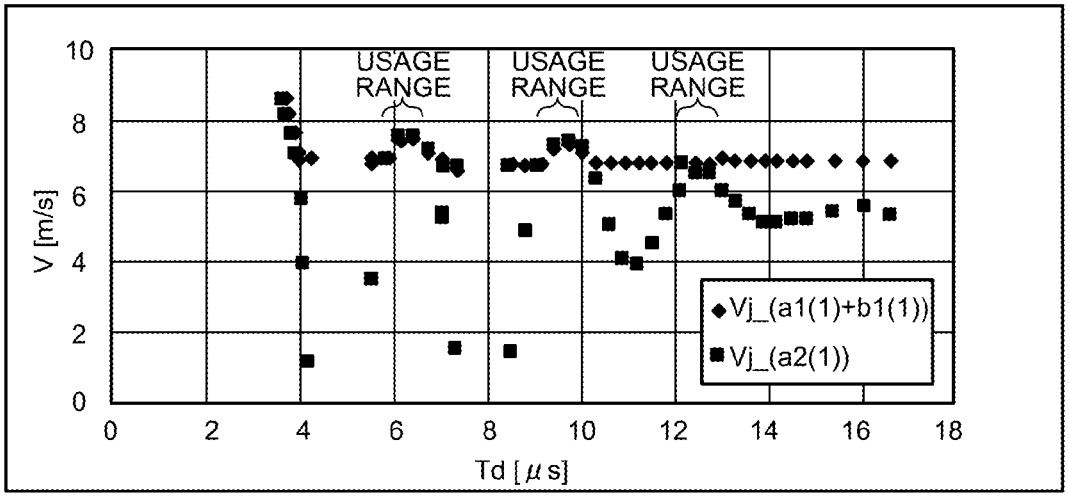

The pulse unit interval Td(k−1) is configured such that the liquid droplet speed of the subsequent pulse unit P(k) after the previous pulse unit P(k−1) is applied becomes approximately the maximum as shown in FIG. 11. FIG. 11 is a diagram illustrating the residual vibration after the pulse unit P(1) is applied with the liquid droplet discharge head (the discharge liquid droplet speed of the subsequent pulse unit P(2)). Section (a) of FIG. 11 represents a strength of the pulse V. FIG. 11B represents a speed Vj of the liquid droplet discharged with the pulse. In section (a) of FIG. 11, the vertical axis denotes a voltage, and the horizontal axis denotes a time. In section (b) of FIG. 11, the vertical axis denotes the speed of the liquid droplet, and the horizontal axis denotes a time.

The pulse strengths Vp_ak(i) and Vp_bk(j) are configured such that, with the pulse unit interval Td(k−1), the speed Vj(k) of the merged liquid droplet M(k) formed by the subsequent pulse unit P(k) satisfy Vj(k)>Vj(k−1). Vj(k−1) is a speed of the merged liquid droplet M(k−1) formed by the previous pulse unit P(k−1). In FIG. 11, the pulse strength V_a2(1) as shown in section (a) of FIG. 11 is configured such that the peak of the speed vibration of the speed Vj_(a1(1)+b1(1)) of the liquid droplet as shown in section (b) of FIG. 11 is more than the speed Vj_a2(1) of the liquid droplet as shown in section (b) of FIG. 11.

In the present embodiment, the first pulse P_ak(i) has a pulse width of about ¾ Tc, and is longer than the resonance peak by about ¼ Tc. The second pulse p_bk(j) has a pulse width of about ½ Tc, and is around the resonance peak. In the present embodiment, the second pulse p_bk(j) has a predetermined width equal to about ½ of the Helmholtz period of the liquid droplet discharge head. The first pulse p_ak(i) has a predetermined width which is different from about ½ of the Helmholtz period of the liquid droplet discharge head. Therefore, preferable discharge stability can be obtained.

Figure 13:
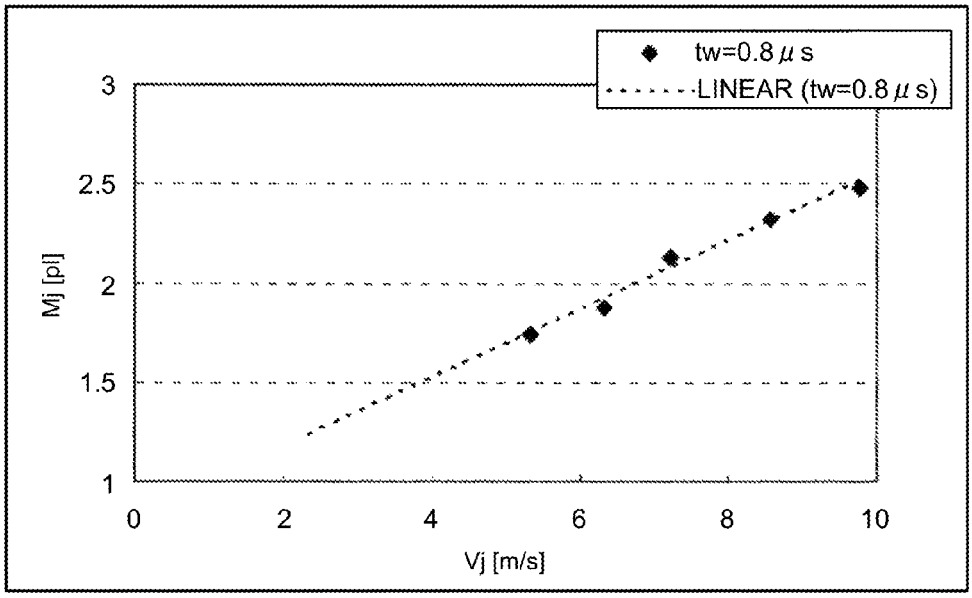
FIG. 13 is a diagram illustrating a relationship of a discharge liquid droplet speed and a discharge liquid droplet volume.

In the present embodiment, as shown in FIG. 12 and FIG. 13, a large liquid droplet of which speed is relatively slower is discharged with the first pulse p_ak(i), and a liquid droplet of which speed is relatively faster is discharged with the second pulse p_bk(j). In FIG. 13, the vertical axis denotes the volume of the liquid droplet, and the horizontal axis denotes the speed of the liquid droplet.

In the present embodiment, the pulse width of the first pulse P_ak(i) is preferably more than the pulse width of the second pulse p_bk(j).

For example, the pulse width corresponding to a range out of the peak of the speed shown in section (b) of FIG. 12 (tw_ak(i) usage range) is the pulse width of the first pulse p_ak(i). On the other hand, the pulse width corresponding to a range close to the peak of the speed shown in section (b) of FIG. 12 (tw_bk(j) usage range) is the pulse width of the second pulse p_bk(j). Section (b) of FIG. 12 shows an example where the Helmholtz period Tc is about 3, and the pulse width of the second pulse p_bk(j) is about 0.8. In section (b) of FIG. 12, the waveform portion in the hold state (for example, the element d shown in section (a) of FIG. 12) is the pulse width on the horizontal axis. Therefore, when converted to the pulse width pw (distance between the middle points of the expanding waveform element and the shrinking waveform element), about 0.8 corresponds to a pulse width pw of about 1.5 (=½ Tc).

When the configuration is made under the above condition, as shown in FIG. 12 and FIG. 13, with respect to the same liquid droplet speed, the volume of the liquid droplet discharged with the first pulse P_ak(i) can be configured to be more than the liquid droplet discharged with the second pulse p_bk(j). More specifically, to ensure a merged liquid droplet volume of the same target, if the volume of the liquid droplet discharged with the second pulse p_bk(j) is configured to be relatively small, the residual vibration after the liquid droplet discharged with the second pulse p_bk(j) can be further reduced.

Under a condition where the formation of the meniscus is likely to be unstable, e.g., the viscosity of the ink is low, or the water repellent property of the nozzle surface is weak, and in a case where a pulse using around the resonance peak (corresponding to the second pulse p_bk(j)) is applied with approximately resonance timing as shown in FIG. 8, unexpected discharge abnormality such as bent ejection is likely to occur. In addition, in a case where a single pulse or multiple pulse greatly away from the resonance peak for the first pulse p_ak(i) are applied, unexpected discharge abnormality such as bent ejection is likely to occur in the same manner.

However, when a pulse using around the resonance peak (corresponding to the second pulse p_bk(j)) is applied to meniscus in a sufficiently vibration-suppressed state by giving a relatively strong energy, unexpected discharge abnormality such as bent ejection is not likely to occur, and liquid droplets having high linearity can be discharged.

Figure 14:
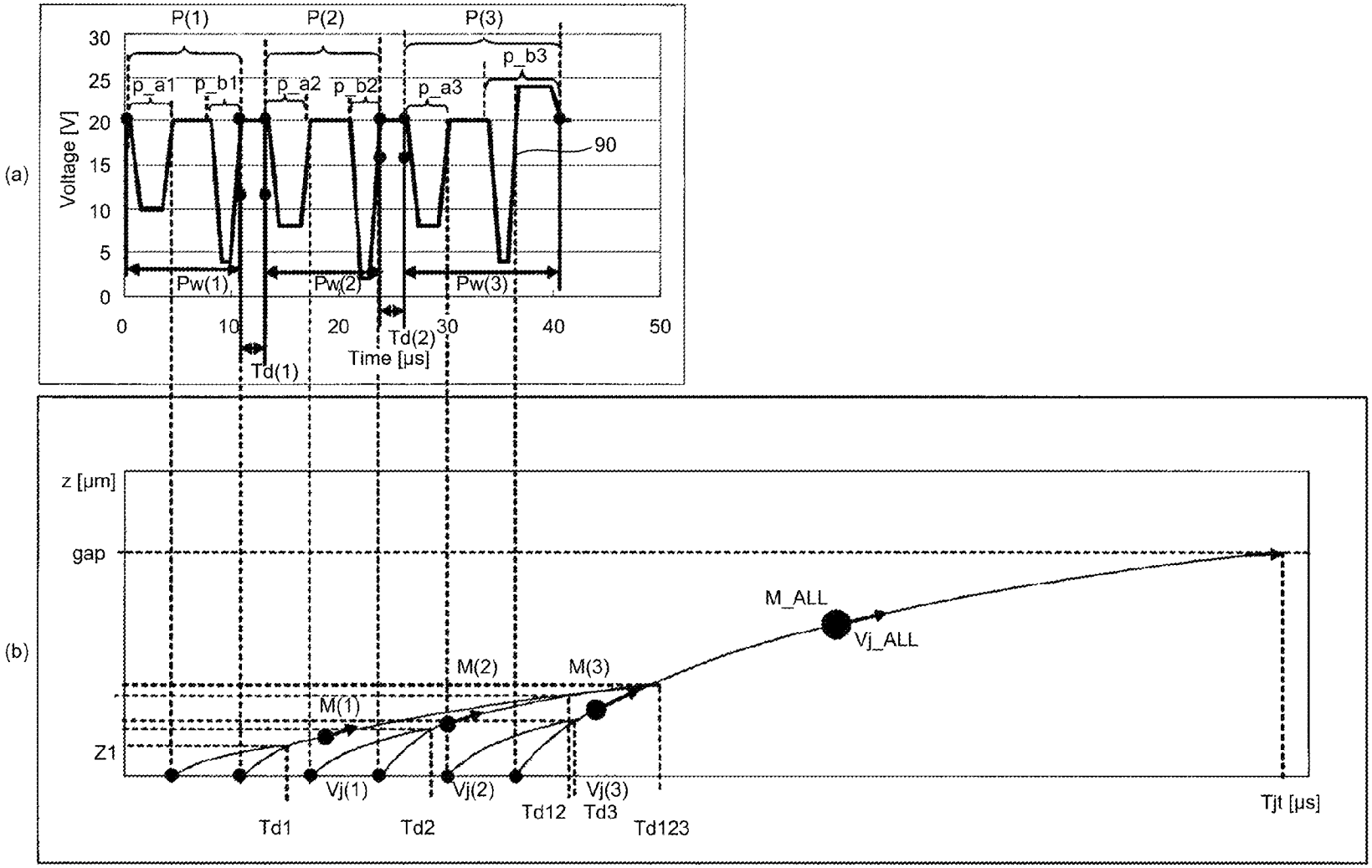
FIG. 14 is a diagram illustrating flight of a liquid droplet and merge process.

Therefore, in the present embodiment, even with the driving under the condition that the formation of the meniscus is likely to be unstable, i.e., even when the liquid droplet M_ak (i) discharged with the first pulse p_ak(i) is discharged in a bent manner, the liquid droplet M_ak(i) is captured by the fast liquid droplet M_bk(j) discharged with the second pulse p_bk (j) that is discharged immediately after the liquid droplet M_ak(i) as shown in FIG. 14. Therefore, as a result, before the liquid droplet M_ak(i) greatly deviates from the route, the merged liquid droplet M_ALL merged by being captured by the liquid droplet M_bk(j) flies. FIG. 14 is a diagram illustrating flight of an liquid droplet and merge process. M(1) as shown in section (b) of FIG. 14 is a merged liquid droplet obtained by merging the liquid droplet discharged with the first pulse P_a1 and the liquid droplet discharged with the second pulse p_b1. Vj(1) denotes the speed of the merged liquid droplet M(1). M(2) is a merged liquid droplet obtained by merging the liquid droplet discharged with the first pulse P_a2 and the liquid droplet discharged with the second pulse p_b2. Vj(2) is a speed of the merged liquid droplet M(2). M(3) is a merged liquid droplet obtained by merging the liquid droplet discharged with the first pulse P_a3 and the liquid droplet discharged with the second pulse p_b3. Vj(3) is the speed of the merged liquid droplet M(3). M_ALL is a merged liquid droplet obtained by merging the merged liquid droplets M(1), M(2), and M(3). Vj_ALL is the speed of the merged liquid droplet M_ALL.

Figure 15:
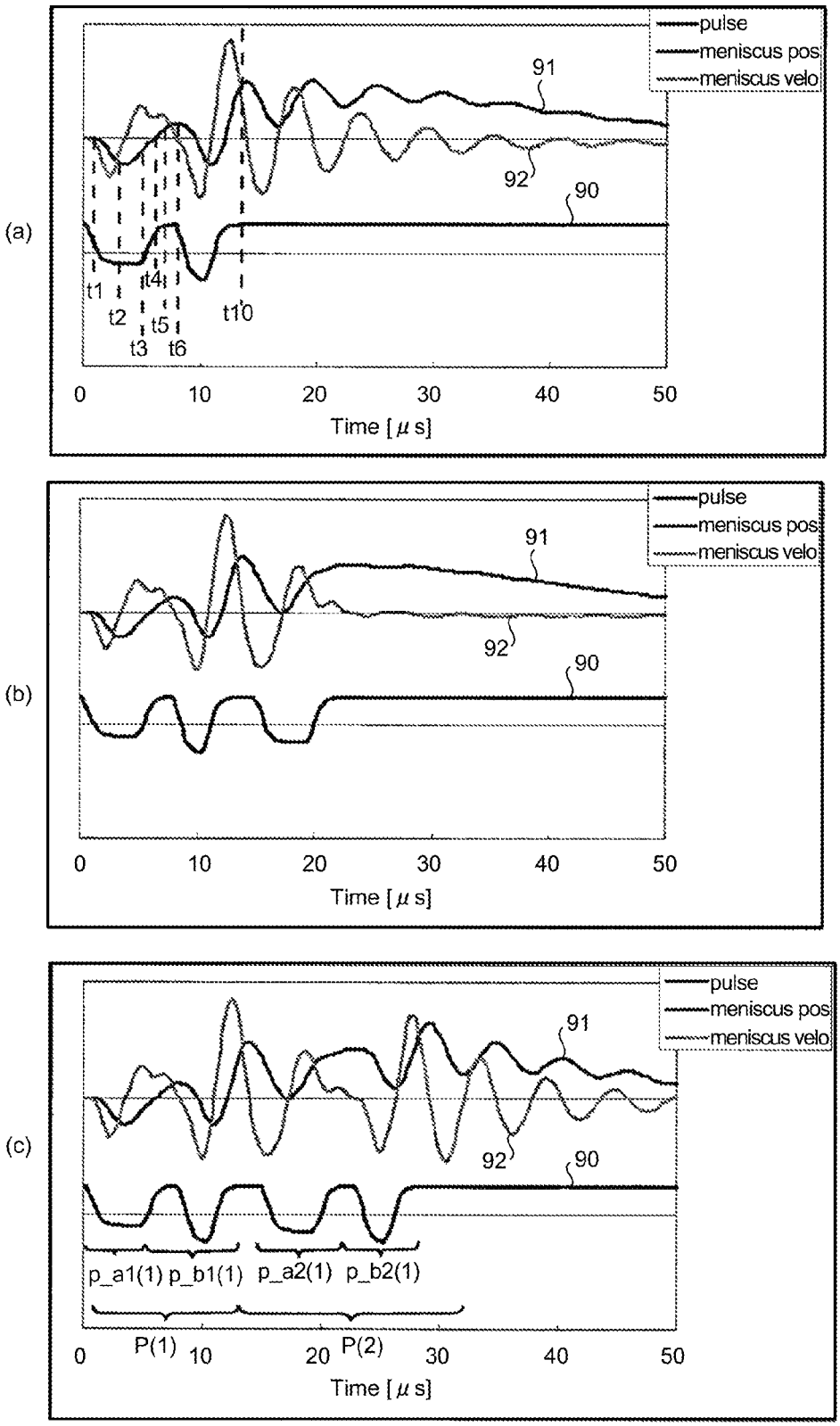
FIG. 15 a diagram illustrating numeric value calculation result of a meniscus speed and a meniscus displacement when a driving waveform is applied.

FIG. 15 illustrates numeric value calculation result of a meniscus speed and a meniscus displacement when a driving waveform is applied. For the sake of brevity, the calculation model does not include the volume change of the meniscus with the liquid droplet discharge. In FIG. 15, the driving waveform 90 denotes a driving waveform of liquid droplets. The waveform 91 represents a meniscus displacement. The waveform 92 represents a meniscus speed.

Immediately after the second pulse p_bk(j) of which energy is high is applied, a large meniscus residual vibration remains. However, when the first pulse p_ak+1(1) of the subsequent pulse unit is applied, the attenuation of the vibration is promoted. More specifically, the first pulse p_ak(1) at the forefront portion of the pulse unit P(k) also has a residual vibration suppression function immediately after the immediately-before pulse unit P(k−1).

Therefore, even when many pulse units P(k) are applied, the vibration of the meniscus is not amplified, and therefore, a large liquid droplet can be discharged without losing the discharge stability. At the same time, it is less likely to be affected by the residual vibration across different pulse units P(k), and more specifically there is less interaction between the pulse units P(k), and a relatively independent design can be made for each pulse unit P(k). For this reason, the flexibility of the configuration of the driving waveform can be enhanced.

The driving waveform 90 according to the present embodiment is configured in units of pulse unit P(k). Then, the second pulse p_bk(j) using the resonance peak that is less likely to be affected by the variation of the acoustic natural period Tc is inserted into each pulse unit P(k). The applied energy of the second pulse p_bk(j) is relatively larger than the first pulse p_ak(i) that is likely to be affected by the variation of the acoustic natural period Tc. Therefore, this can suppress the variation of the discharge characteristic of each channel of the merged liquid droplet.

Therefore, even when a relatively low viscosity ink is used, preferable discharge stability is enabled during high frequency driving, so that a large-sized liquid droplet of which drop amount is relatively high as well as liquid droplets of various sizes of which drop amounts are less than the large-sized liquid droplet can be discharged. In addition, the driving waveform 90 can be obtained, in which the variation of the discharge characteristic for each channel is not increased.

Actions and Effects of the Ink Jet Recording Apparatus According to the Present Embodiment The pulse unit P(k) included in the driving waveform 90 according to the present embodiment includes one or more first pulses p_ak(i) and one or more second pulses p_bk(j) arranged after the first pulse p_ak(i) for discharging the liquid droplet. The pulse width of the second pulse p_bk(j) is equal to ½ of the Helmholtz period of the liquid droplet discharge head. The pulse width of the first pulse p_ak(i) is a predetermined width different from ½ of the Helmholtz period of the liquid droplet discharge head. Therefore, preferable discharge stability can be obtained.

The pulse width of the first pulse p_ak(i) is configured to be more than the pulse width of the second pulse p_bk(j). Accordingly, to ensure a merged liquid droplet volume of the same target, the volume of the liquid droplet discharged with the second pulse p_bk(j) is configured to be relatively small. Then, the residual vibration after the discharge of the liquid droplet discharged with the second pulse p_bk(j) can be further reduced.

The pulse interval between the last pulse p_ak(M) included in the first pulse p_ak(i) and the first pulse p_bk(1) included in the second pulse p_bk(j) is configured to be a predetermined interval equal to the Helmholtz period of the liquid droplet discharge head. Therefore, the liquid droplet formed with the second pulse p_bk(j) can be reliably merged with the liquid droplet formed with the first pulse p_ak(i).

The pulse unit interval between the pulse unit P(k) and the subsequent pulse unit P(k+1) is configured to be a predetermined interval equal to the Helmholtz period of the liquid droplet discharge head. Therefore, the liquid droplet formed with the subsequent pulse unit P(k+1) can be reliably merged with the liquid droplet formed with the pulse unit P(k).

Subsequently, another embodiment will be explained.

Figure 16:
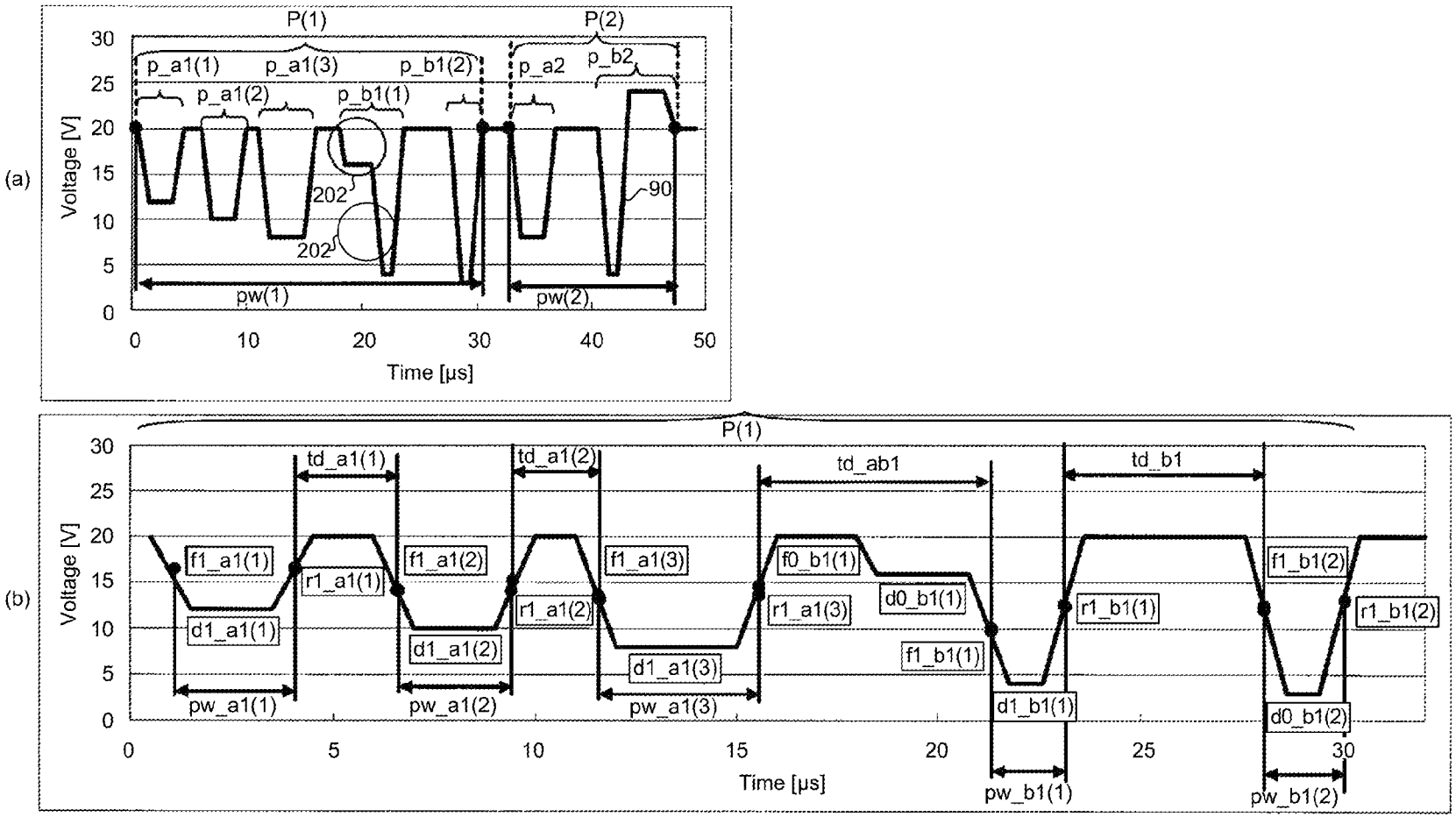
FIG. 16 is a diagram illustrating an example of configuration of a driving waveform according to another embodiment.

In the present embodiment, as shown in FIG. 16, at least one or more second pulses of the second pulses p_bk(j) have multiple expanding waveform elements 202 before the shrinking waveform element r1_bk j) for discharging the liquid droplet. Accordingly, the liquid droplet discharged with the second pulse p_bk(j) can be configured to be less likely to be bent. The present embodiment will be hereinafter explained with reference to FIG. 16. FIG. 16 is a diagram illustrating an example of configuration of the driving waveform according to the present embodiment.

The driving waveform 90 according to the present embodiment is configured such that, as shown in FIG. 16, at least one or more second pulses of the second pulses p_bk(j) include multiple expanding waveform elements 202 before the shrinking waveform element r1_bk(j) for discharging the liquid droplet.

Section (a) of FIG. 16 illustrate an example of configuration of the driving waveform 90 according to the present embodiment. Section (b) of FIG. 16 illustrates an example of configuration of a pulse unit P(1) as shown in section (a) of FIG. 16. In FIG. 16, the vertical axis denotes a voltage, and the horizontal axis denotes a time.

The driving waveform 90 as shown in section (a) of FIG. 16 includes a pulse unit P(1) and a pulse unit P(2). The pulse unit P(1) includes three first pulses p_a1(1), p_a1(2), p_a1(3) and two second pulses p_b1(1), p_b1(2). The pulse unit P(2) includes one first pulse p_a2 and one second pulse p_b2.

Section (b) of FIG. 16 illustrates an example of configuration of the pulse unit P(1) as shown in section (b) of FIG. 16. The element f as shown in section (b) of FIG. 16 indicates a dropping waveform element which is an expanding waveform element. The element d indicates a waveform element in the hold state after dropping. The element r denotes a rising waveform element which is a shrinking waveform element. The pulse width pw means a distance between middle points of the expanding waveform element and the shrinking waveform element within the same pulse in which the discharge is performed. The pulse interval td is a distance between middle points of the shrinking waveform element of a pulse before the discharge is performed and an expanding waveform element of a pulse after the discharge is performed.

Figure 17:
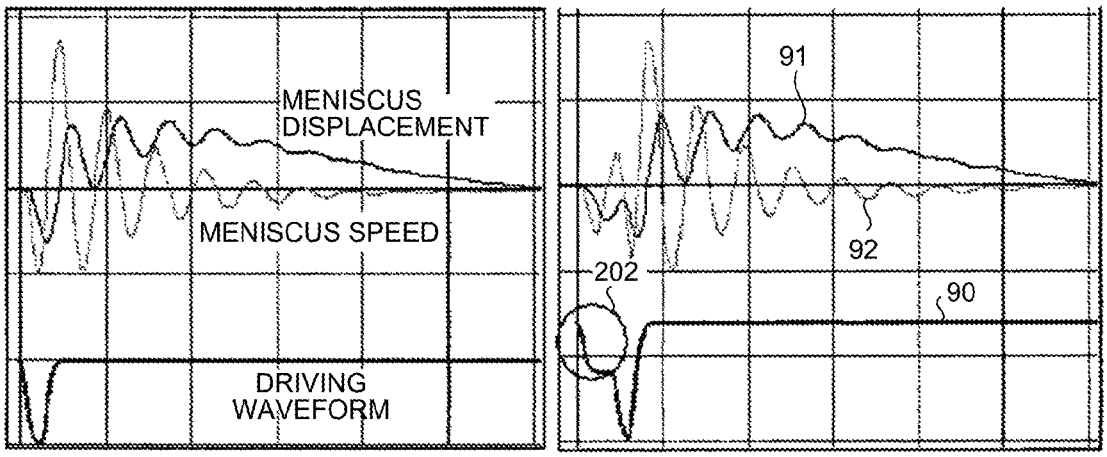
FIG. 17 is a diagram illustrating numeric value calculation result of a meniscus displacement and a meniscus speed when a driving waveform having an expanding waveform element is applied.

A meniscus speed and a meniscus displacement in a case where the driving waveform 90 including the expanding waveform element 202 is applied are shown in FIG. 17. FIG. 17 is a diagram illustrating the meniscus speed and the meniscus displacement in the case where the driving waveform 90 including the expanding waveform element 202 is applied. In FIG. 17, the driving waveform 90 represents the driving waveform of the liquid droplet. The waveform 91 represents the meniscus displacement. The waveform 92 represents the meniscus speed.

As shown in FIG. 17, the change of the meniscus speed during the discharge shrinking element is suppressed, so that the disturbance of the form of the inner wall of the nozzle is less likely to affect the formation of the meniscus. In addition, it is less likely to be affected by the variation of the acoustic natural period Tc and the like, and as a result, the ejection is less likely to be bent. Therefore, the liquid droplet discharged with the second pulse p_bk(j) can be configured to be less likely to be bent.

Figure 18:
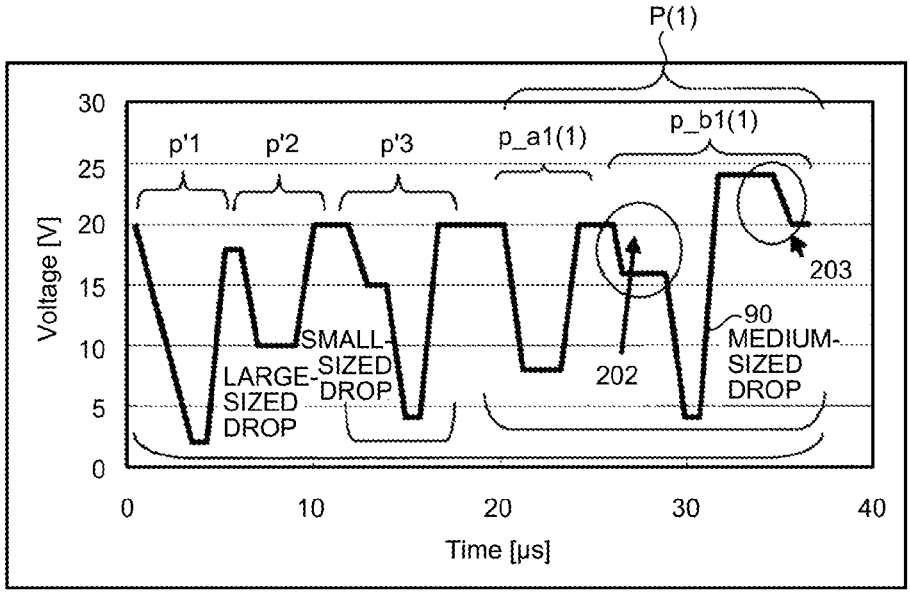
FIG. 18 is a diagram illustrating an example of configuration of the driving waveform.

It should be noted that the driving waveform may include a driving pulse other than the pulse unit P(k). For example, as shown in FIG. 18, the driving waveform may include driving pulses (p'1, p'2, p'3) other than the pulse unit P(1). Like a small-sized drop, a type of drop that is driven with a driving pulse other than the pulse unit P(k) may be included. The first pulse p_ak(i) and the second pulse p_bk(j) included in the pulse unit P(k) may include a vibration control unit 203. It should be noted that the first pulse p_ak(i) and the second pulse p_bk(j) are preferably such that the error with respect to the target value is within a range of ⅛ Tc. Accordingly, even when a relatively low viscosity ink is used, preferable discharge stability during the high frequency driving can be provided without losing the flexibility of the configuration of the driving waveform. As a result, a liquid droplet of which drop amount is relatively high and liquid droplets of multiple sizes of which drop amounts are less than that can be discharged. In addition, the driving waveform that does not increase the variation of the discharge characteristic for each channel can be obtained.

The control operation of each unit constituting the ink jet recording apparatus according to the embodiments explained above can be executed using hardware, software, or a complex configuration of them both.

When processing is executed using software, a program recording a processing sequence can be installed to a memory in a computer incorporated into dedicated hardware, and the processing can be executed. Alternatively, the processing can be executed by installing the program to a memory in a general-purpose computer capable of executing various kinds of processing.

For example, the program can be recorded, in advance, to a hard disk or a ROM (Read Only Memory) serving as a recording medium. Alternatively, the program can be temporarily or permanently stored (recorded) to a removable recording medium. Such removable recoding medium can be provided as so-called package software. The removable recording medium includes various kinds of recording media such a magnetic disk and a semiconductor memory.

It should be noted that the program is installed from the removable recording medium explained above to the computer. Alternatively, the program is wirelessly transferred from a download site to a computer. Still alternatively, the program is transferred by means of a wire via a network to a computer.

Each device constituting the ink jet recording apparatus according to the above embodiments is not limited to execution of the processing in accordance with the time sequence according to the processing operation explained in the above embodiments. For example, the processing may be configured to be executed in accordance with the processing performance of the device executing the processing, or may be configured to be executed as necessary, in parallel, or individually.

According to the embodiments, preferable stability of discharge can be obtained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a liquid droplet discharge head;

a pressure generator; and a driving waveform generator configured to generate a driving waveform including a plurality of pulse units for driving the pressure generator to discharge liquid droplets, wherein each of the pulse units includes one or more first pulses, and one or more second pulses arranged after the first pulses, the one or more second pulses have a pulse width that generates a resonance with the liquid droplet discharge head, and the one or more first pulses have a pulse width different from the pulse width of the one or more second pulses.

2. The image forming apparatus according to claim 1, wherein the pulse width of the one or more second pulses is within a desired error range with respect to ½of Helmholtz period of the liquid droplet discharge head.

3. The image forming apparatus according to claim 1, wherein the pulse width of the one or more second pulses is greater than the pulse width of the one or more first pulses.

4. The image forming apparatus according to claim 1, wherein a pulse interval between the one or more first pulses and the one or more second pulses is equal to a Helmholtz period of the liquid droplet discharge head.

5. The image forming apparatus according to claim 1, wherein an interval between a first pulse unit and a subsequent second pulse unit is equal to a Helmholtz period of the liquid droplet discharge head.

6. The image forming apparatus according to claim 1, further comprising a selecting unit configured to select one or more pulse units from among the plurality of pulse units and to eject, from the liquid droplet discharge head, one or more types of liquid droplets having different volumes according to the selected one or more pulse units, independently of each other.

7. The image forming apparatus according to claim 1, wherein a combination of the one or more first pulses and the one or more second pulses is associated with the discharge of a single one of the liquid droplets.

8. A method for controlling a liquid droplet discharge head, the method comprising generating a driving waveform including a plurality of pulse units for driving a pressure generator of a liquid droplet discharge head for discharging liquid droplets, wherein the pulse unit includes one or more first pulses, and one or more second pulses arranged after the first pulses, the one or more second pulses have a pulse width that generates a resonance with the liquid droplet discharge head, and the one or more first pulses have a pulse width different from the pulse width of the one or more second pulses.

9. The method according to claim 8, wherein a combination of the one or more first pulses and the one or more second pulses is associated with the discharge of a single one of the liquid droplets.

* * * * *